US010470616B2

(12) United States Patent
Nilsson et al.

(10) Patent No.: US 10,470,616 B2
(45) Date of Patent: Nov. 12, 2019

(54) PUMP FOR A SYSTEM FOR DISPENSING A LIQUID AS A SPRAY, A SPRAY NOZZLE UNIT, A SYSTEM FOR DISPENSING A LIQUID AS A SPRAY AND A METHOD FOR DISPENSING A LIQUID AS A SPRAY

(71) Applicant: SCA Hygiene Products AB, Göteborg (SE)

(72) Inventors: Hugo Nilsson, Ljungby (SE); Peter Bergman, Göteborg (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 51 days.

(21) Appl. No.: 15/542,516

(22) PCT Filed: Jan. 12, 2015

(86) PCT No.: PCT/SE2015/050010
§ 371 (c)(1),
(2) Date: Jul. 10, 2017

(87) PCT Pub. No.: WO2016/114689
PCT Pub. Date: Jul. 21, 2016

(65) Prior Publication Data
US 2018/0263431 A1 Sep. 20, 2018

(51) Int. Cl.
*A47K 5/12* (2006.01)
*B65D 47/20* (2006.01)
(Continued)

(52) U.S. Cl.
CPC ..... *A47K 5/1209* (2013.01); *B05B 11/0059* (2013.01); *B05B 11/3032* (2013.01); *B05B 11/3064* (2013.01); *B65D 47/2062* (2013.01)

(58) Field of Classification Search
CPC ..... A47K 5/1209; B05B 15/62; B05B 1/06; B05B 11/0059; B05B 11/3032;
(Continued)

(56) References Cited

U.S. PATENT DOCUMENTS 3,141,580 A 7/1964 Rogers
3,628,700 A * 12/1971 Dodoghue ..... B05B 7/0037 222/187
(Continued)

FOREIGN PATENT DOCUMENTS

CN 101945603 A 1/2011
CN 101945604 A 1/2011
(Continued)

OTHER PUBLICATIONS

Colombian Office Action Oficio N° 11093 issued in Colombian patent application No. NC2017/0007326, dated Oct. 12, 2018 (8 pages) and its partial English-language translation thereof (5 pages).
(Continued)

*Primary Examiner* — Benjamin R Shaw
(74) *Attorney, Agent, or Firm* — Drinker Biddle & Reath LLP

(57) ABSTRACT

A pump includes a housing forming a chamber; a dispensing opening; and a regulator fixedly arranged in the chamber. The regulator includes an inner valve for regulating a flow of liquid between the container and the chamber; an outer valve for regulating a flow of liquid between the chamber and the dispensing opening; a stem resilient along its length, sideways bendable, and extending in a longitudinal direction of the housing between the inner valve and the outer valve; and a displacement guide located at an outer portion of the stem on an inner side of the outer valve. An outer perimeter of the displacement guide and a portion of an internal surface of a guide region located adjacent the displacement
(Continued)

guide are adapted to transfer the sideways bending of the stem to a relative displacement between the outer valve and the housing along the longitudinal direction of the housing.

26 Claims, 12 Drawing Sheets

(51) Int. Cl.
*B05B 11/00* (2006.01)
*B05B 15/62* (2018.01)
*B05B 1/06* (2006.01)
*B05B 1/34* (2006.01)

(58) Field of Classification Search
CPC ..... B05B 11/3033; B05B 11/3064; B05B 1/3436; B65D 47/2062
USPC ..... 222/207
See application file for complete search history.

(56) References Cited

U.S. PATENT DOCUMENTS 4,088,248 A * 5/1978 Blake ..... B05B 11/3028 222/207
4,091,966 A * 5/1978 Laauwe ..... B05B 11/0059 222/211
4,773,569 A * 9/1988 Larsson ..... B67D 7/0216 222/108
4,776,495 A * 10/1988 Vignot ..... A47K 5/1209 222/206
4,946,075 A * 8/1990 Lundback ..... B67D 1/0001 222/181.3
5,056,690 A 10/1991 Ichihara et al.
5,524,795 A * 6/1996 Lee ..... B65D 47/2068 222/207
5,730,327 A 3/1998 Stern
6,918,547 B2 7/2005 Jaeger et al.
7,225,948 B2 6/2007 Ophardt et al.
8,695,856 B2 4/2014 Nilsson
8,701,942 B2 4/2014 Nilsson
8,708,200 B2 4/2014 Nilsson
9,527,092 B2 12/2016 Miyamoto et al.
2004/0083547 A1 5/2004 Mercier
2005/0035157 A1 2/2005 Brennan et al.
2007/0194054 A1 8/2007 Ganzeboom et al.
2010/0320226 A1* 12/2010 Nilsson ..... A47K 5/1209 222/207
2010/0327019 A1* 12/2010 Nilsson ..... A47K 5/1209 222/214
2011/0036863 A1* 2/2011 Nilsson ..... A47K 5/1209 222/207
2011/0253744 A1 10/2011 Pelfrey
2012/0158048 A1 6/2012 Roush et al.
2012/0248149 A1 10/2012 Pelfrey
2014/0217123 A1 8/2014 Ophardt et al.
2014/0367422 A1* 12/2014 Drennow ..... A47K 5/1215 222/207

FOREIGN PATENT DOCUMENTS

CN 101952178 A 1/2011
CN 102985188 A 3/2013
EP 2441365 A1 4/2012
EP 2583756 A1 4/2013

OTHER PUBLICATIONS

Partial supplementary European search report dated Jul. 31, 2018 issued in European patent application No. 15 878 173.2.
Extended European search report dated Nov. 20, 2018 issued in European patent application No. 15 878 173.2.
First Chinese Office Action dated Jan. 17, 2019 issued in Chinese patent application No. 201580073156.5.
Colombian Office Action Oficio N° 982 issued in Colombian patent application No. NC2017/0007326, dated Mar. 13, 2019 (10 pages) and its partial English-language translation thereof (4 pages).

* cited by examiner

PUMP FOR A SYSTEM FOR DISPENSING A LIQUID AS A SPRAY, A SPRAY NOZZLE UNIT, A SYSTEM FOR DISPENSING A LIQUID AS A SPRAY AND A METHOD FOR DISPENSING A LIQUID AS A SPRAY

CROSS-REFERENCE TO PRIOR APPLICATION

This application is a § 371 National Stage Application of PCT/SE2015/050010 filed Jan. 12, 2015, which is incorporated herein in its entirety.

TECHNICAL FIELD

The present disclosure relates to a pump for a system for dispensing a liquid as a spray. The disclosure further relates to a spray nozzle unit, a system for dispensing a liquid as a spray and a method for dispensing a liquid as a spray.

BACKGROUND

The disclosure relates to the field of suction pumps for dispensing a liquid material, such as soap or alcohol sanitizer or detergent out of a container such as a bottle or the like. In use, the container is interconnected to the pump, and introduced in a dispenser, which is typically fixedly arranged on a wall in a bathroom or the like. Certain dispensers include a non-disposable pump which is integrated with the dispenser, and to which disposable containers may be coupled. Other dispensing systems may include a disposable pump, which may be connected to a disposable container for attachment to a multiple-use dispenser.

In many applications, the liquid is dispensed as a liquid. However, it is sometimes preferred to dispense the liquid as a spray, e.g. in order to cover an area, e.g. spraying soap on a hand. Moreover, dispensing by spraying distributes the liquid better as compared to dispensing as a liquid. It is possible to decrease the amount of liquid used at each dispensing operation as compared to conventional systems dispensing in liquid state.

A vast number of different suction pumps have been proposed in the past for dispensing liquids. Many suction pumps include a pressure chamber, from which a volume of liquid may be dispensed. The liquid leaving the chamber creates a negative pressure in the fluid chamber, which negative pressure functions to draw new liquid from the container into the pressure chamber, which thereby is filled and ready to dispense a new volume of liquid.

However, when dispensing a liquid as a spray, the pressure difference required from the pump is larger than for conventional systems dispensing the liquid in liquid state, since the pressure difference is also utilized to give kinetic energy to the liquid in order to break it up into droplets forming the spray. The process of forming the droplets of the spray is known as atomization.

One type of known dispensers includes an actuation means for activating the pump and dispensing a volume of fluid. Another type of known dispensers is arranged such that a portion of the pump extends out from the dispenser, displaying an actuation means arranged in integrity with the pump. There are generally two kinds of actuation means, whether integrated in the dispenser or in the pump.

One kind is a longitudinally acting actuation means. Longitudinally relates in this context to a direction parallel to the dispensing direction and to a spout of the pump. Pumps for longitudinal actuation often include a slidable piston which may be pushed/pulled in a longitudinal direction for diminishing/expanding the volume inside the pressure chamber of the pump, whereby the pumping effect is created. When the actuation means is formed in integrity with the pump, it may include an outlet for dispensing the liquid.

Another kind of actuation means is a transversely acting actuation means. Transversely relates in this context to a direction transverse to the dispensing direction and transverse to a spout of the pump. Pumps for transversal actuation are typically to be arranged in a fixed dispenser which includes a transversally acting actuation means. The transversally acting actuation means may be a bar or the like, which upon transversal displacement acts to diminish the volume inside the pressure chamber of the pump.

As the pumps, containers are known in a large variety of forms. One particular type of containers is collapsible containers, which are intended to gradually collapse, decreasing their inner volume, as fluid is dispensed therefrom. Collapsible containers are particularly advantageous in view of hygienic considerations, as the integrity of the container is maintained throughout the emptying process, which ensures that no contaminants are introduced thereto, and that any tampering with the content of the container is impossible without visibly damaging the container. Use of collapsible containers involves particular requirements to the pumps. In particular, the suction force created by the pump must be sufficient not only to dispense the liquid, but also to contract the container. Moreover, a negative pressure may be created in the container, striving to expand the container to its original shape. Hence, the pump must be able to overcome also the negative pressure.

One type of collapsible containers is simple bags, generally formed from some soft plastic material. Bags are generally relatively easy to collapse, and the bag walls would not strive to re-expand after collapse, hence the bag walls would not contribute to any negative pressure in the bag.

Another type of collapsible containers has at least one relatively rigid wall, towards which the collapse of the other, less rigid walls of the container will be directed. Hence, hereinafter, this type of container is referred to as a semi-rigid collapsible container. This type of collapsible containers is advantageous in that information may be printed on the rigid wall, such that the information remains clearly visible and undistorted regardless of the state of collapse of the container. Moreover, for some contents, containers having at least one relatively rigid wall may be preferable over bags. However, collapsible containers having at least one relatively rigid wall may require a greater suction force generated from the pump in order to overcome the negative pressure created in the container during emptying thereof than the bags.

For disposable pumps, there is a general desire that the pump should be relatively easy and economical to manufacture. Moreover, it is advantageous if the pump includes materials that may easily be recycled after disposal and even more advantageous if the pump may be recycled as a single unit without need of separating its parts after disposal.

SUMMARY

It is desired to overcome or ameliorate at least one of the disadvantages of the known technology, or to provide a useful alternative.

Thus, in a first aspect of the present invention there is provided a pump for a system for dispensing a liquid as a spray, in particular for a dispensing system which includes a compressible container. The pump includes a housing forming a chamber and a dispensing opening, wherein the pressure in the chamber may be varied for pumping liquid from the container to the chamber, and further from the chamber to the dispensing opening. The pump further includes a regulator fixedly arranged in the chamber. The housing is resilient and has a longitudinal direction. The regulator includes an inner valve for regulating a flow of liquid between the container and the chamber, an outer valve for regulating a flow of liquid between the chamber and the dispensing opening, and a stem extending in the longitudinal direction of the housing at least between the inner valve and the outer valve. The stem is resilient along its length so as to be sideways bendable from an original shape to a distorted shape. The regulator further includes a displacement guide located at an outer portion of the stem on an inner side of the outer valve, and the housing comprises a guide region located adjacent to the displacement guide. An outer perimeter of the displacement guide and at least a portion of an internal surface of the guide region are adapted to each other so as to allow relative displacement between the displacement guide and the guide region substantially along the longitudinal direction of the housing, so as to transfer the sideways bending of the stem to a relative displacement between the outer valve and the housing along the longitudinal direction of the housing.

In this application, the term "inner" or "inside" is generally used for an upstream position, which is closer to the container than to the dispensing opening, whereas the term "outer" or "outside" is generally used for a downstream position, which is closer to the dispensing opening than to the container. The inner valve is hence located closer to the container than the outer valve.

The relative displacement between the displacement guide and the guide region occurs substantially along the longitudinal direction of the housing. The outer valve is then displaced in relation to the housing along the longitudinal direction of the housing. The outer valve may move up and down in relation to the housing. In embodiments, the relative displacement between the displacement guide and the guide region occur along the longitudinal direction of the housing only. The outer valve is not tilted in relation to the inner surface of the housing during the displacement. Instead, an outer circumference of the outer valve, i.e. the circumference being furthest away from the container is substantially perpendicular to the longitudinal direction of the housing. However, if the housing is bent in a way influencing a portion of the housing surrounding the outer valve, the outer valve will follow the bending movement of the housing.

The pump as disclosed herein dispenses the liquid by spraying. It does not include any piston. Instead a regulator as described herein is utilized. In some embodiments, the pump is a disposable pump.

An external force being applied to the housing causes the stem to bend sideways, i.e. in a transverse direction being perpendicular to the longitudinal direction. The force is can be applied in the transverse direction. However, the force may also be substantially transverse or at least have a transverse component being larger than its longitudinal component. The stem may include a flexible central portion. The whole stem may be flexible.

The displacement guide is located closer to the outer valve than to a midpoint of the stem, for example adjacent to the outer valve.

The internal surface of the housing faces in the direction of the chamber.

In some embodiments, a gap between the outer perimeter of the displacement guide and the portion of the internal surface of the guide region includes substantially longitudinally parallel surfaces, e.g. the outer perimeter of the displacement guide and the portion of the internal surface of the guide region being concentric to each other. In some embodiments, the gap decreases somewhat in a direction towards the dispensing opening, e.g. due to gradually increasing wall thickness of the housing.

In some embodiments, the outer perimeter of the displacement guide is adapted to follow at least a portion of the internal surface of the housing during the relative displacement.

In some embodiments, the relative displacement between the displacement guide and the guide region along the longitudinal direction of the housing results in a displacement of the outer valve towards the dispensing opening, when the stem moves from the original shape to the distorted shape. The stem may in addition, or as a complement, be extended in the longitudinal direction due to high pressure in a middle compartment of the chamber.

In some embodiments, the outer perimeter of the displacement guide is located at a larger radial distance from an axial centre line of the stem than a radial distance of a main surface of the stem. Hence the displacement guide may have a larger cross-sectional area than the stem. The radial distances are defined from an axial centre line of the stem when the stem is in its original shape.

In some embodiments, the displacement guide forms a portion of the regulator, for example the displacement guide may be an integral part of the regulator. This may be beneficial from a manufacturing point of view, also making it possible to provide a pump with fewer parts than a conventional spray pump.

As an alternative, the displacement guide can be a separate component, which may be attached to the stem, e.g. by a snap-fit connection.

In some embodiments, a cross-sectional area of the chamber is smaller in the guide region than in a region of the chamber being longitudinally inwards of the guide region. The chamber wall in the guide region may be stiffer and/or thicker than the chamber wall longitudinally inwards of the guide region. Hence the chamber wall being located longitudinally inwards of the guide region may be easier to compress and distort than the chamber wall of the guide region. The chamber wall in the guide region may be relatively stiff, helping to provide the desired longitudinal displacement and to avoid transverse displacement.

In some embodiments, the internal surface of the housing includes at least one first passage for the liquid, the first passage being located longitudinally outwards of the outer valve, when the stem is in the original shape. The first passage may help the liquid to pass the outer valve when dispensing.

In some embodiments, the first passage forms a groove in the internal surface of the housing, the groove extending substantially perpendicular to the longitudinal direction of the housing. The groove may be circumferential.

In some embodiments, the relative displacement between the displacement guide and the guide region along the longitudinal direction of the housing results in a displacement of the outer valve towards the dispensing opening to a location adjacent to the first passage, when the stem is in the distorted shape. In some embodiments, the displacement of the outer valve in relation to the housing is influenced by the distorted shapes of the stem and/or the housing, as well as the pressure in the chamber. The stem may in addition, or as a complement, be extended in the longitudinal direction due to high pressure in a middle compartment of the chamber.

In some embodiments, the displacement guide and/or the guide region include(s) at least one second passage for the liquid longitudinally passing the displacement guide. The second passage may pass through the displacement guide and/or at a side wall of the displacement guide. The second passage may also be formed in the housing. The second passage extends at least partially along the longitudinal direction.

The inner valve includes a central portion and a peripheral portion, the central portion being more rigid than the peripheral portion. The more rigid central portion helps the inner valve to avoid turning inside out like an umbrella accidentally may be turned inside out by a strong wind. This is advantageous, since spray dispensing results in a higher pressure in the chamber than dispensing as a liquid, as is mentioned above.

In some embodiments, the internal surface of the housing includes a first shoulder adapted to cooperate with the peripheral portion of the inner valve to form an inner seal. The first shoulder may cooperate adjacent to a rim of the peripheral portion of the inner valve. For example, the inner diameter of the housing may narrow to form the first shoulder against which the inner valve may abut in the transverse direction. The size and shape of the first shoulder can be adapted to the inner valve so as to form a reliable one-way valve.

In some embodiments, the internal surface of the housing includes a second shoulder adapted to form an abutment for the inner valve, the second shoulder being located longitudinally inwards of the first shoulder, the chamber having a smaller cross-sectional area at the second shoulder than at the first shoulder. The inner diameter of the housing may narrow to form a seat against which the inner valve may abut in the longitudinal direction. The size and shape of the second shoulder can be adapted to the inner valve so as to form a reliable one-way valve.

In some embodiments, the first shoulder and the second shoulder are adapted to cooperate with the inner valve to restrict backward opening of the inner valve. As described, the two shoulders can provide abutment in two different directions, however both of them may cooperate with the peripheral portion of the inner valve. The first shoulder and the second shoulder may be located close to each other, e.g. within a range of 1-5 mm, or within a range of 2-4 mm. The interspace between the shoulders is defined between their respective outer edges. The size of the interspace between the shoulders may be selected to be long enough to allow transport of the liquid and yet short enough to provide the desired support to the inner valve. It may be enough to only use one of the shoulders, but it is in some embodiments preferred to have both.

In some embodiments, the outer valve includes a central portion and a peripheral portion, the central portion being more rigid than the peripheral portion. The peripheral portion of the outer valve may include a lip adapted to cooperate with the internal surface of the housing, the lip protruding in a direction towards the internal surface of the housing. The lip may include an edge defining a seal line between the outer valve and the inner wall of the housing.

In some embodiments, the pump comprises, or consists of, a one-piece housing and a one-piece regulator. The displacement guide may form a portion of the regulator or it may be a separate component attachable to the regulator. However, in particular embodiments, the displacement guide forms an integral part of the regulator in order to keep the number of parts of the pump as low as possible. The guide region may form a part of said housing or it may be a separate component attachable to the housing. However, in particular embodiments, the guide region is an integral portion of a wall of said housing.

In a second aspect of the present invention there is provided a spray nozzle unit for a system for dispensing a liquid as a spray, in particular for a dispensing system which includes a compressible container. The spray nozzle unit includes an outer portion and an inner portion. The outer portion includes a cavity for receiving the inner portion and a spray aperture for dispensing the spray in a spray direction. The inner portion fits into the outer portion in such a way that at least one conduit for the liquid is provided through the spray nozzle unit. The spray nozzle unit includes at least two channels for transport of the liquid, which channels are arranged to meet adjacent to the spray aperture, the channels being in fluid connection with the at least one conduit and extending substantially perpendicular to the spray direction.

The spray nozzle unit is intended to be placed at a dispensing opening of a pump, e.g. like the pump described above. However, even if it is preferred that the spray nozzle unit is combined with the pump as described above, it would also be possible to utilize the spray nozzle unit in other kinds of pumps and/or to utilize the pump with other kinds of spray nozzle units.

The interspace between the inner portion and the outer portion forms at least partly the at least one conduit for the liquid. The channels are in fluid connection with the at least one conduit and leads to the spray aperture, such that the liquid to be dispensed as a spray reaches the spray aperture.

In some embodiments, the channels are located in the outer portion and/or the inner portion of the spray nozzle unit. For example, the channels can be formed as grooves in the outer portion and/or the inner portion.

The at least two channels meet each other at an angle. In some embodiments, the spray nozzle unit includes four channels, e.g. formed as grooves in the outer portion, for example arranged to meet each other at right angles. In other embodiments, the spray nozzle unit includes three channels, e.g. formed as grooves in the outer portion, for example arranged to meet each other at 120 degree angles. In general, the spray nozzle unit includes n channels, n being an integer larger than 1, for example arranged to meet each other at 360/n degrees angles.

In some embodiments, the outer portion includes a groove in a wall of the cavity, the inner portion being adapted to be snap-fitted into the groove.

In some embodiments, the spray aperture includes parallel walls, e.g. forming a small cylindrical tube. Due to the high pressure in the pump, a spray cone is obtained. It is hence possible to cover an area on the sprayed item, e.g. on a hand held below the pump, although the spray aperture includes parallel walls. There is hence, with a pump as described herein, no need to make the spray aperture conical in order to cover an area. The size of the spray cone may be influenced by the external force applied to the pump. Generally, the higher the force is, the higher pressure is built up in the chamber, the wider the spray cone is formed.

The size and/or shape of the spray aperture and in particular its outer end may be selected dependent on the liquid to be dispensed. The size and/or shape of the outer end is can be selected such that the surface tension of the liquid prevents the liquid from dripping through the spray aperture. Purely as an example, the outer end of the spray aperture may have a circular cross-sectional shape, e.g. with a diameter being in the range of 0.2 to 1 mm, or in the range of 0.4-0.6 mm.

In some embodiments, the pump comprises or consists of plastic material, in particular embodiments, the whole pump consists of the same kind of plastic material. If the pump includes the spray nozzle unit, the spray nozzle unit may comprise or consist of the same kind of plastic material. Further, a connector for connecting the pump to the container may also comprise or consist of the same kind of plastic material. Thereby the pump is recyclable as a single unit, without previous disassembly.

In a third aspect of the present invention there is provided a dispensing system for dispensing a liquid as a spray including a pump as described herein and a collapsible container for containing liquid to be dispensed via the pump. The pump is in fluid-tight connection with the container.

In a fourth aspect of the present invention there is provided a method for dispensing a liquid as a spray from a dispensing system as described herein. The method includes:

subjecting the chamber to an external force, the external force providing an increased pressure in the chamber, letting the external force bend the stem sideways to the distorted shape, and transferring the sideways bending of the stem to a relative displacement between the outer valve and the housing along the longitudinal direction of the housing by the displacement guide, thereby allowing the liquid to pass the outer valve.

The pressure is high enough to make the liquid dispense as a spray. This pressure is higher than a pressure utilized to dispense as a liquid.

In some embodiments, the relative displacement between the outer valve and the housing along the longitudinal direction of the housing includes an extension of the stem due to increased pressure in the chamber caused by the external force.

BRIEF DESCRIPTION OF THE DRAWINGS

Embodiments of the invention will be further described by way of examples with reference to the accompanying drawings in which.

The same reference numbers are used to denote the same features in all of the drawings.

It should be noted that the appended drawings are not necessarily drawn to scale and that the dimensions of some features may have been exaggerated for the sake of clarity.

DETAILED DESCRIPTION OF PARTICULAR EMBODIMENTS

It should be realized that the embodiments are included in order to explain principles of the invention and not to limit the scope of the invention, defined by the appended claims. Details from two or more of the embodiments may be combined with each other.

Figure 1:
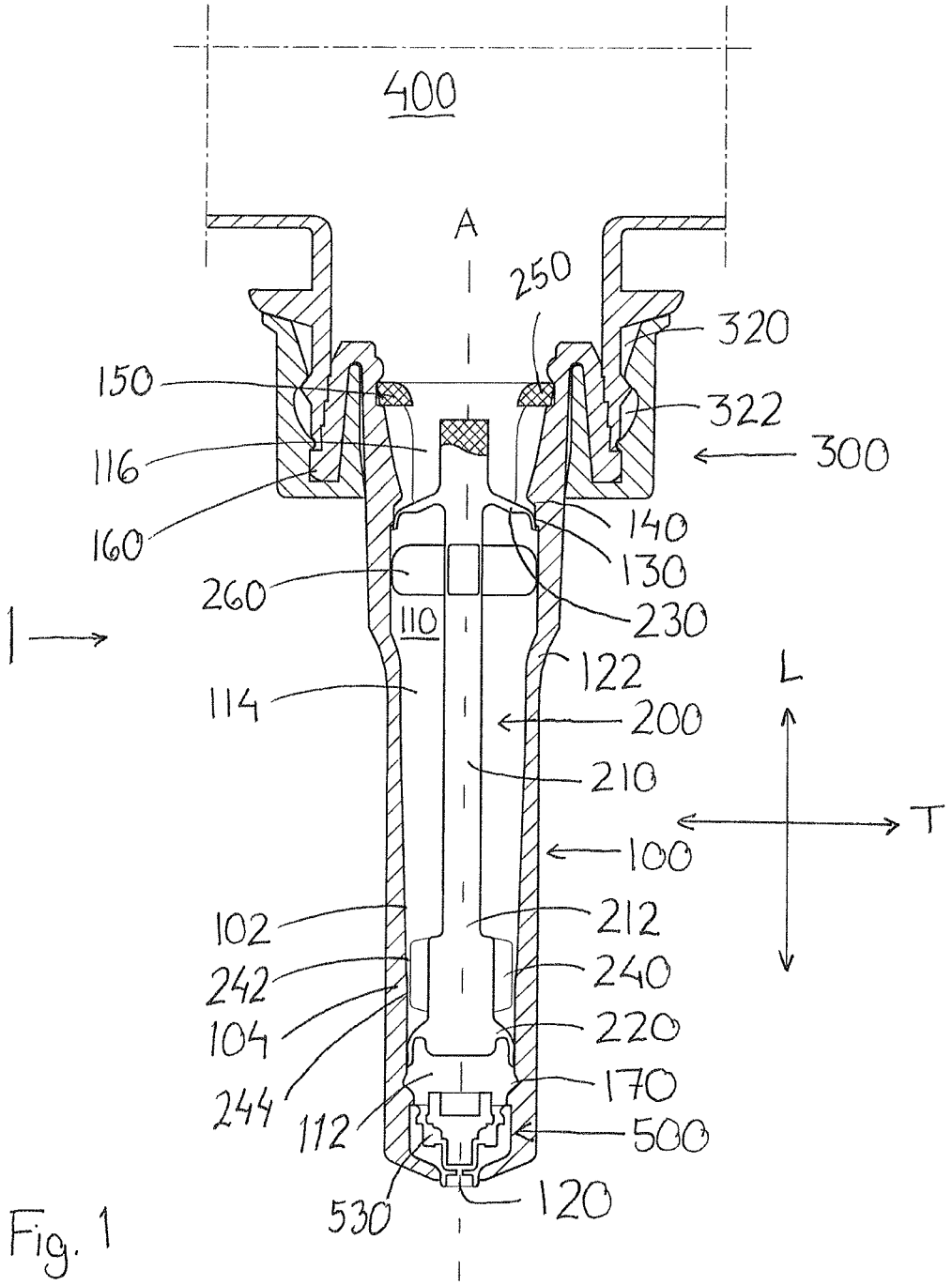
FIG. 1 illustrates a pump according to an embodiment of the invention.

FIG. 1 illustrates a pump 1 according to an embodiment of the invention. The pump is shown as a part of a system for dispensing a liquid as a spray. The system includes a compressible container 400 holding the liquid, such as liquid soap or alcohol detergent. The pump 1 includes a housing 100 forming a chamber 110 and a dispensing opening 120, wherein the pressure in the chamber 110 may be varied for pumping liquid from the container 400 to the chamber 110, and further from the chamber 110 to the dispensing opening 120, as is further explained below in conjunction with FIGS. 9*a* and 9*b*. The pump 1 includes a regulator 200 being fixedly arranged in the chamber 110. A connector 300 helps to attach the pump 1 to the container 400.

The housing 100 is resilient and has a longitudinal direction L, which substantially coincides with a spray direction. The housing 100 has an internal surface 102 defining the chamber 110. The chamber 110 includes an outer compartment 112, a middle compartment 114 and an inner compartment 116. The longitudinal end portion of the outer compartment 112, in which the dispensing opening 120 is provided, is provided with a spray nozzle unit 500 further described below in conjunction with FIGS. 5*a-c* and 6*a-c*. The spray nozzle unit 500 protrudes longitudinally from the housing 100, e.g. by a distance in the range of 0.1-0.5 mm.

The regulator 200 includes an outer valve 220 for regulating a flow of liquid between the chamber 110 and the dispensing opening 120 and an inner valve 230 for regulating a flow of the liquid between the container 400 and the chamber 110. The regulator 200 further includes a stem 210 extending in the longitudinal direction L of the housing 100 at least between the inner valve 230 and the outer valve 220. The stem 210 is resilient so as to be sideways bendable from an original shape to a distorted shape. The regulator 200 also includes a fixation member 250 for attaching the regulator to the housing 100.

In this application, the term "inner" or "inside" is generally used for an upstream position, which is closer to the container 400 than to the dispensing opening 120, whereas the term "outer" or "outside" is generally used for a downstream position, which is closer to the dispensing opening 120 than to the container 400. The inner valve 230 is hence located closer to the container 400 than the outer valve 220.

The pump 1 further includes a displacement guide 240 located at an outer portion 212 of the stem 210 on an inner side of the outer valve 220. In the illustrated embodiment, the displacement guide 240 forms an integral part of the regulator 200, but the displacement guide 240 may also be a separate unit attached to the regulator 200. The displacement guide 240 is adapted to transfer a sideways bending of the stem 210 in a transverse direction T to a relative displacement between the outer valve 220 and the housing 100 in the longitudinal direction L of the housing 100. There is therefore provided a guide region 104 in the housing 100 at a location corresponding to that of the displacement guide 240, such that an internal surface of the guide region 104 faces the displacement guide 240. There is thereby formed a narrow circumferential gap 242 between the internal surface of the guide region 104 and an outer surface 244 of the displacement guide 240. The gap 242 is so narrow that the guide region 104 controls the relative movement of the displacement guide 240.

Although the gap 242 may be equidistant as seen in the longitudinal direction L, it is in the illustrated embodiment of FIG. 1, shown that the gap 242 narrows towards the outer valve 230. This is an effect of that the cross-sectional area of the chamber 110 successively decreases in a direction towards the dispensing opening 120. The outer surface 244 of the displacement guide 240 is in sliding contact with the housing 100 at least along an outer portion of the displacement guide 240, i.e. the outer surface 244 of the displacement guide 240 may slide along the guide region 104. However, when the housing 100 is compressed by an external force F, the displacement guide 240 may be in sliding contact with the guide region along a larger portion of the displacement guide 240.

The substantially longitudinal orientation of the gap 242 makes the displacement guide 240 move longitudinally in relation to the housing 100, when the external force F is applied to the housing 100. The force causes the stem 210 to bend sideways, i.e. in the transverse direction T. This is further explained below in conjunction with FIGS. 9*a* and 9*b*. The force F can be applied in a transverse direction T being perpendicular to the longitudinal direction L. However, the force F may also be substantially transverse or at least have a transverse component being larger than its longitudinal component.

The Regulator

Figure 2A:
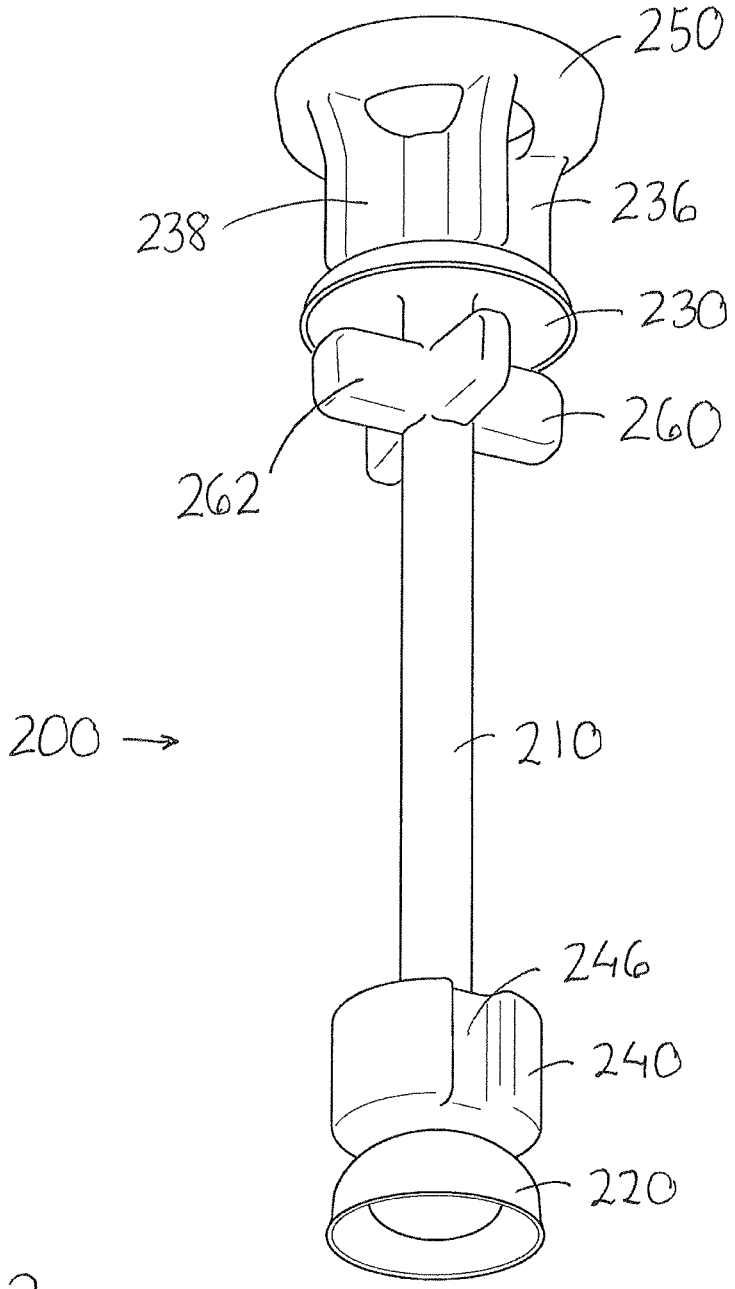
FIGS. 2*a* to 2*c* illustrate a regulator of the embodiment of FIG. 1.
Figure 2B:
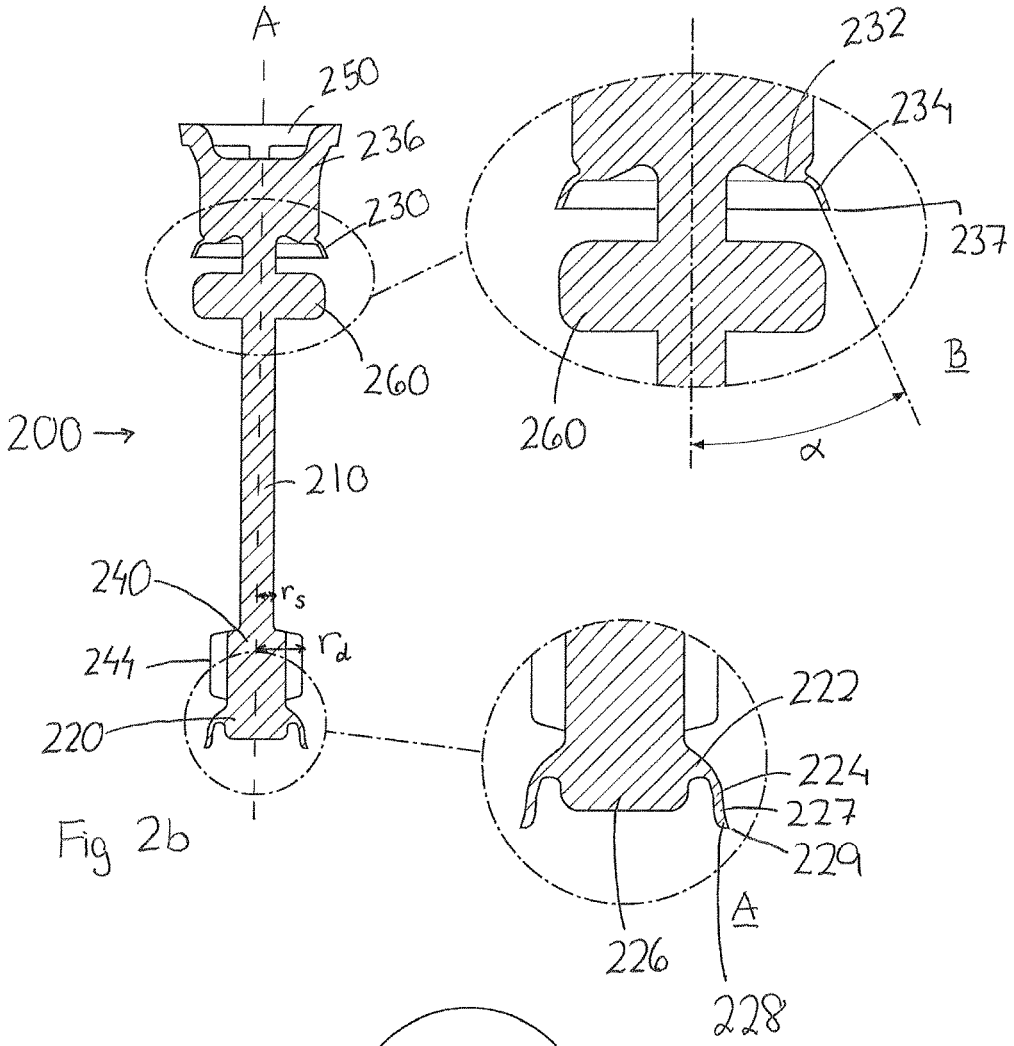
Figure 2C:
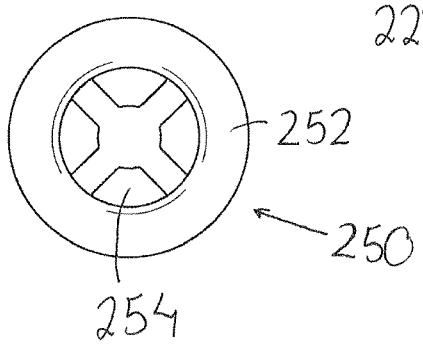

FIGS. 2*a* to 2*c* illustrate the regulator 200 for the illustrated embodiment of the pump 1 of FIG. 1. FIG. 2*a* is a perspective view of the regulator 200. FIG. 2*b* is a cross-sectional view of the regulator 200 made in another cross-section than for FIG. 1. FIG. 2*c* is a view of the regulator 200 as seen from the innermost end. The regulator 200 includes the outer valve 220, the displacement guide 240, the stem 210, the inner valve 230, a fixation member 250 and an optional guide member 260.

The Outer Valve

The outer valve 220 is the valve located closest to the dispensing opening 120. As seen in FIGS. 2*a* and 2*b*, the outer valve 220 has a shape of a bell having its open side in an outward direction. As is best seen in the enlargement A of FIG. 2*b*, the outer valve 220 includes a central portion 222 adjacent to the stem 210 and a peripheral portion 224. The central portion 222 is more rigid than peripheral portion 224.

The peripheral portion 224 is flexible in a direction towards the centre of the valve 220, and resilient so as to resume its original shape after flexing. The flexibility of the peripheral portion 224 is advantageously ensured by the peripheral portion 224 having a substantially constant thickness. In the centre of the outer valve 220, surrounded by the peripheral portion 224, there is a knob 226. The knob 226 and the stem material will contribute to the rigidity of the outer valve 220.

In the enlargement A, it is seen how the peripheral portion 224 forms a substantially straight portion 227 before finishing with a lip 228 protruding outwards in a direction towards the internal surface 102 of the housing 100, such that the lip 228 ends with an edge 229 intended to seal against the internal surface 102 of the housing 100, when the outer valve 220 is in a closed position. It is believed to be advantageous if the substantially straight portion 227 may rest substantially in parallel to the internal surface 102 of the housing 100. The lip 228 provides a defined seal line. Thereby an outer valve 220 being able to cope with the pressure differences desired in a pump in order to provide the liquid as a spray may be provided. As mentioned above, these pressure differences are generally higher than those used when dispensing the liquid as a liquid. As is further described below, the peripheral portion 224 and in particular the lip 228 has a shape and location chosen to cooperate with a first passage 170 located external to the outer valve 220 when the pump is in its closed state as illustrated in FIG. 1. The first passage 170 forms a circumferential groove in the internal surface 102 of the housing 100.

It is understood that the outer valve 220, when positioned in the chamber 110, is circumferentially compressed so as to accomplish the sealing function. Hence, in a relaxed, uncompressed state, the outer valve 220 has an outer diameter being greater than the diameter of the chamber 110 at the location of the outer valve 220. As may be gleaned from FIG. 1, in the illustrated embodiment the outer valve 220 will be located in the outer compartment 112 of the chamber.

The difference between the inner diameter of the chamber 110 at the location of the outer valve 220, and the outer diameter of the outer valve 220 when in an uncompressed state may be selected dependent on the properties of the liquid, e.g. its viscosity. It may be between 0.09 and 0.20 mm, or between 0.10 and 0.20 mm, or between 0.10 and 0.15 mm.

The Displacement Guide

Next to the outer valve 220 on the stem 210, there is provided a displacement guide 240, which provides the relative longitudinal displacement between the outer valve 220 and the housing 100 as described above.

The displacement guide 240 may advantageously extend along the circumference of the stem 210 and also extend along the stem 210, so as to symmetrically restrict the movement of the stem 210 in all directions in and external to the displacement guide 240. The displacement guide 240 includes at least one second passage 246 allowing the liquid to pass, in the illustrated embodiment there are two second passages 246 located at the outer surface 244 of the displacement guide 240. However, the second passage may also be located close to an axial centre line A of the displacement guide 240. The second passage may also be located in the housing 100. The second passage extends at least partially in the longitudinal direction L.

The outer surface 244 of the displacement guide 240 is located at a larger radial distance $r_d$ from the axial centre line A of the stem 210 than a radial distance $r_s$ of a main surface of the stem 210 from the axial centre line A. Hence the displacement guide 240 has a larger cross-sectional area than the stem 210.

The Stem

The stem 210 extends generally at least between the inner valve 230 and the outer valve 220. The stem 210 thus provides two valve seats, one for the outer valve 220 and one for the inner valve 230. The stem 210 is resilient so as to be sideways bendable in the transverse direction T and is capable of resuming its original shape after bending. The length and diameter of the stem 210 may be selected taking these considerations into account, as well as others regarding e.g. the size of the pump. Purely as an example, the diameter of the stem 210 may be in the range of 2-5 mm, and the length of the entire regulator 200 in the range of 30-100 mm, e.g. in the range of 40-70 mm or in the range of 50-60 mm. In the illustrated embodiment, the stem 210 has a constant diameter, but it may vary as well.

The Inner Valve

The inner valve 230 being closest to the container 400 includes a valve member, extending circumferentially from the stem 210. As is best seen in the enlargement B of FIG. 2*b*, the inner valve 230 includes a central portion 232 adjacent to the stem 210 and a peripheral portion 234. The central portion 232 is more rigid than the peripheral portion 234. The central portion 232 has a larger cross-sectional thickness than the peripheral portion 234, as may be gleaned from FIG. 1. The central portion 232 is further stabilized by a brace member 236 extending between the fixation member 250 and the peripheral portion 234 of the inner valve 230. The inner valve 230 has the shape of an umbrella or a jelly-fish.

A portion of the central portion 232 of the inner valve 230 is connected to the brace member 236. The brace member 236 is more rigid than the inner valve 230 and functions to restrict the movement of the inner valve 230. Advantageously, the brace member 236 is attached to the upper surface of the central portion 232 at a number of attachment locations. At these locations, the brace member 236 rigidly connects the inner valve 230 with the stem 210. Hence, the inner valve 230 is fixed at the attachment locations, and inhibited from moving outwardly or inwardly in the longitudinal direction L at these locations.

By inhibiting inward motion, the brace member 236 ensures that the inner valve 230 cannot be wrung in the wrong direction, i.e. in a direction opposite to the dispensing direction, even if the pressure in the chamber 110 should be higher than the pressure in the container 400 to which the pump is connected. This feature is particularly useful when the pump is used to empty a collapsible container 400. In a collapsible container 400, and in particular for the type of collapsible container 400 being semi-rigid, a negative pressure may be created in the container as liquid is drawn out of it via the pump. Hence, when the pump is in a closed position and the chamber 110 is full with liquid to be dispensed at the next dispensing cycle, the pressure in the chamber 110 may be larger than the pressure in the container 400. Moreover, the pressure gradient between the chamber 110 and the container 400 may be relatively large. The brace member 236 contributes to the inner valve 230 being a strong one-way valve which may withstand relatively large pressure gradients in a direction opposite to the dispensing direction without opening.

By inhibiting outward motion of the central portion 232, the brace member 236 contributes to controlling the opening of the inner valve 230.

In the illustrated embodiment, the brace member 236 includes four wings 238 extending from the stem 210 and forming a cross with the stem 210 in the middle. The wings 238 are connected to the inner valve 230 at attachment locations along the outer side of the wings as seen in the longitudinal direction L.

It is understood that the brace member 236 should not inhibit movement of the entire valve member. Some portions of the valve member must remain movable in order to be able to open and close. This may be ensured by the attachment locations between the brace member 236 and the valve member being restricted to the central portion 232 of the valve member, leaving the peripheral portion 234 without any attachment to the brace member 236 and extending along the circumference of the valve member. Alternatively, or in combination with the peripheral portion 234, portions of the central portion 232 extending between spaced attachment locations of the brace member 236 may be movable so as to open and close the valve. However, in particular embodiments for use with a collapsible container in which a negative pressure may be created as described above, the peripheral portion 234 is arranged, such that the capacity of the brace member 236 of inhibiting backward opening of the inner valve 230 need not be traded off in order to ensure opening of the inner valve 230 in the correct direction.

The peripheral portion 234 will contact the housing 100 when in a closed position, and will be movable away from the housing 100 to an open position. As may be gleaned from FIG. 1, the peripheral portion 234 may advantageously cooperate with a first shoulder 130 formed in the internal surface 102 of the housing 100. The location of the first shoulder 130 corresponds to that of the inner valve 230 when in a closed position, such that an edge 237 of the peripheral portion 234 seals against the first shoulder 130.

The internal surface 102 of the housing 100 is further also provided with a second shoulder 140 located inwards of the first shoulder 130. The second shoulder 140 is adapted to cooperate with the inner valve 230 to restrict backward opening of the inner valve 230 by providing an abutment for the inner valve 230. In the illustrated embodiment, the second shoulder 140 cooperates with the inner valve 230 via the brace member 236, although it may, as an alternative, cooperate with the inner valve 230 directly.

The peripheral portion 234 of the inner valve 230 has a substantially straight cross-sectional shape extending in a direction forming an angle $\alpha$ to the longitudinal direction L. The angle $\alpha$ may be in the range 15-30 degrees, 20-30 degrees, or 20-25 degrees.

The thickness of the peripheral portion 234 should be selected depending on the resilient plastic material, such that the flexibility of the peripheral portion 234 allows for opening and closing of the inner valve 230. It is believed to be advantageous in view of resiliency if the cross-sectional thickness of the peripheral portion 234 is substantially constant throughout the peripheral portion 234. The thickness may be between 0.2 and 0.4 mm. In the illustrated embodiment, the thickness of the rim is about 0.3 mm. The thickness may be selected dependent on the properties of the liquid, e.g. its viscosity.

Generally, it will be understood that the inner valve 230 may contribute to the tightness of the entire system consisting of a collapsible container in liquid tight connection to the pump. The inner valve 230 should be a resistant one-way valve, opening only in the dispensing direction and at an inner valve opening pressure. As a negative pressure is created in the container, only a greater negative pressure in the chamber 110 may cause the inner valve 230 to open. Negative pressure in the chamber 110 is only created right after dispensing of the liquid, when the chamber 110 is to be refilled. In all other situations, in particular in the situation when the pump 1 is not in use but the chamber 110 shall be closed and full with liquid, there is negative pressure in the container 400 and a higher pressure in the chamber 110. Hence, the inner valve 230 will securely seal the container 400 from the chamber 110. This means that, in this situation, the outer valve 220 need only ensure that the content of the chamber 110 does not leak—i.e. the outer valve 220 need not carry any weight from the content of the container 400.

It is understood that the inner valve 230, when positioned in the chamber 110, is circumferentially compressed. Hence, in a relaxed, uncompressed state, the inner valve 230 has an outer diameter being greater than the diameter of the chamber 110 at the location of the inner valve 230. As may be gleaned from FIG. 1, in the illustrated embodiment, the inner valve 230 will be located in an inner portion 114*b* of the middle compartment 114 of the housing 100.

The difference between the inner diameter of the chamber at the location of the inner valve 230, and the outer diameter of the inner valve 230 when in an uncompressed state may be selected dependent on the properties of the liquid, e.g. its viscosity. It may be between 0.20 and 0.35 mm, or between 0.25 and 0.35 mm, or between 0.25 and 0.30 mm.

The Fixation Member

The regulator 200 is moreover provided with fixation means for attaching the regulator 200 in the housing 100. In the illustrated embodiment, the fixation means includes the fixation member 250 arranged at the stem 210. Advantageously, the fixation member 250 is provided as illustrated at the innermost end of the stem 210. The fixation member 250 includes a circular ring 252 which is to be inserted in a corresponding groove 150 at the innermost portion of the housing 100. The open centre 254 of the ring 252 allows for flow of liquid from the container 400 to the pump. The size and shape of the open centre 254 may be selected so as to control the size of the flow from the container 400 into the pump.

The Guide Member

Next to the inner valve 230, on the outer side thereof, the optional guide member 260 is arranged. The guide member 260 extends transversely so as to restrict the bending movement of the stem 210 and generally confine the bending to the portion of the stem 210 extending outside of the guide member 260. As such, the guide member 260 is advantageous to ensure that the function of the inner valve 230 is not affected by the bending motion of the stem 210. The guide member 260 may advantageously extend along the circumference of the stem 210 so as to symmetrically restrict the movement of the stem. In the illustrated embodiment, the guide member 260 is formed by four guide bars 262 being arranged so as to form a cross with the stem 210 in its centre.

The Housing

Figure 3A:
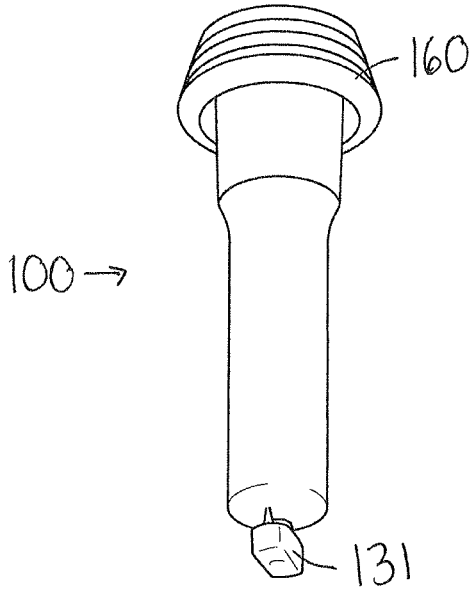
FIGS. 3*a* to 3*c* illustrate a housing of the embodiment of FIG. 1.
Figure 3B:
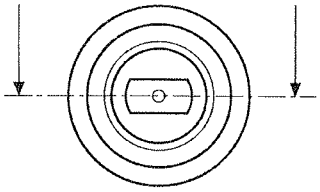
Figure 3C:
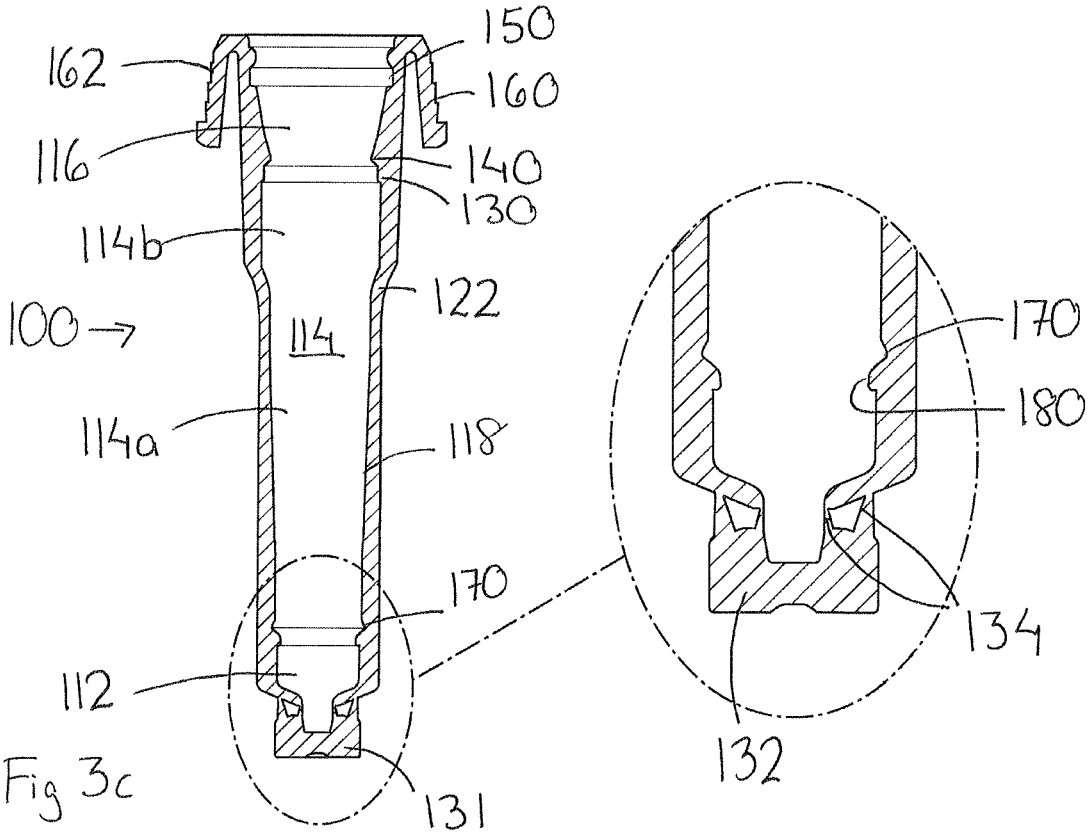

FIGS. 3*a* to 3*c* illustrate the housing 100 of the illustrated embodiment of FIG. 1. FIG. 3*a* is a perspective view of the housing, FIG. 3*b* is a view of the housing as seen from the outermost end, and FIG. 3*c* is a cross-sectional view of the housing. See also the cross-sectional view of the pump 1 of FIG. 1.

The housing 100 is generally cylindrical, extending from an innermost portion being provided with a connector 160 for connection to the container 400, to an outermost portion including the dispensing opening 120. Purely as an example, the length of housing 100 may be in the range of 40-120 mm, e.g. in the range of 50-100 mm or in the range of 60-80 mm.

The Closure

As seen in FIGS. 3*a* to 3*b*, the housing 100 may initially be provided with a closure 131 for sealing the dispensing opening 120. The closure 131 is to be removed when the pump is set in operation. The closure 131 will ensure the integrity of the pump during e.g. transport and storage, so that no debris or contaminants will accidentally come into the housing 100 via the dispensing opening 120. In the illustrated embodiment, the closure 131 is formed in integrity with the housing 100. The closure 131 includes a head 132 which is connected to the portion of the housing 100 surrounding the dispensing opening 120 via weakened portions 134. The thickness of the housing material is reduced in the weakened portions 134, such that the closure 131 may be removed by pulling or twisting the head 132, causing the weakened portions 134 to rupture. The housing 100 will thereafter look like illustrated in FIG. 1. As mentioned above, the spray nozzle unit 500 protrudes longitudinally from the housing 100, e.g. by a distance in the range of 0.1-0.5 mm. Hence, even if the weakened portions 134 are not broken off at a defined line, leaving a beard at the dispensing opening 120, the spray nozzle unit 500 will be configured to protrude externally outside of this beard.

In view of manufacturing as well as security considerations, it is highly advantageous to form the closure 131 in integrity with the housing 100, an example of which is shown in the illustrated embodiment. However, naturally other closures are conceivable, such as a closing tape or a separate closing plug.

The Outer Compartment

The outermost portion of the housing forms the outer compartment 112. As may be gleaned from FIG. 1, the outer valve 220 will be confined in the outer compartment 112 in the assembled pump.

Hence, the inner diameter of the outer compartment 112 and the outer diameter of the outer valve 220 should be adapted so as to provide the desired sealing effect. To that end, the outer diameter of the outer valve 220 is generally made slightly larger than the inner diameter of the outer compartment 112, such that the outer valve 220 is slightly compressed when in place in the outer compartment, causing the inner wall of the outer compartment 112 to press on outer valve 220. The difference in size between the outer compartment 112 and the outer valve 220 may be selected with consideration to the resiliency and flexibility of the outer valve 220 so as to achieve a sufficiently strong seal of the outer valve 220. However, it is to be understood that the size difference referred to in this context is not large. The difference may be selected dependent on the properties of the liquid, e.g. its viscosity.

When the housing 100 is formed from resilient material, as in the illustrated embodiment, it is generally desired that the shape of the housing 100 at the outer compartment 112 is relatively rigid, as otherwise the function of the outer valve 220 to be contained therein might be impaired. Hence, in the illustrated embodiment, the thickness of the housing walls surrounding the outer compartment 112 is relatively large as compared to the thickness of the housing walls in the middle compartment 114. This is due to the frusta-conical chamber of the chamber 110, which is further described below.

The First Passage

The internal surface 102 of the outer compartment 112 is provided with a first passage. In the illustrated embodiment, the first passage is formed by a groove 170, which extends around the circumference of the outer compartment 112 in a plane substantially perpendicular to the longitudinal direction L. The groove 170 is located outwards of the outer valve 220 when the stem 210 is in its original shape. However, when the force F is applied, the stem 210 is in its distorted shape and is thereby longitudinally displaced in relation to the groove 170, such that the groove 170 will help the liquid to pass the outer valve 220. The stem 210 may in addition, or as a complement, be extended in the longitudinal direction L due to high pressure in the middle compartment 114 of the chamber 110.

Protrusion

Outwards of the groove 170 forming the first passage, the internal surface 102 of the outer compartment 112 is provided with a protrusion 180, which is used to retain the spray nozzle unit 500, for example by means of a snap-fit connection.

The Slope

At the innermost end of the outer compartment 112, i.e. above the outer valve 220, the inner diameter of the housing 100 widens to form a middle compartment 114. The middle compartment 114 will generally contain a volume of liquid to be dispensed. This volume is defined by the outer valve 220 and the inner valve 230. Hence, the size of the middle compartment 114, and hence the distance between the outer valve 220 and the inner valve 230, should suitably be selected in accordance with a desired maximum volume to be dispensed.

In the illustrated embodiment, the inner diameter of an outer portion 114*a* of the middle compartment 114 is wider than the inner diameter of the outer compartment 112. The diameter does not widen abruptly, but is gradually increased along part of the length of the housing 100 so as to form a slope 118. In the illustrated embodiment, the chamber 110 has a general frusta-conical shape in the outer portion 114*a* of the middle compartment 114 and the outer compartment 112, such that the wall thickness decreases substantially linearly from the spray opening 120 in a direction towards the container 400 up to a transfer zone 122 defining a limit between the outer portion 114*a* and the inner portion 114*b* of the middle compartment 114. The shape of the chamber 110 including the slope 118 is chosen to provide a desired valve function at the outer valve 220. In addition, the generally frusta-conical shape has been found to be advantageous during manufacturing of the housing 100. The inner portion 114*b* of the middle compartment 114 has a larger cross-sectional area than the outer portion 114*a*. The thickness of the wall in the middle compartment 114, and in particular in the outer portion 114*a* is chosen such that it allows distortion of the shape of the wall when the external force is applied and yet the wall does not collapse uncontrolledly outside of where the external force is applied.

The First Shoulder

At an inner part of the inner portion 114*b* of middle compartment 114, the internal surface 102 of the housing 100 forms a first shoulder 130 against which the peripheral portion 234 of the inner valve 230 is adapted to form a seal. Hence the inner diameter of the housing 100 narrows to form the first shoulder 130 against which the inner valve 230 may abut in the transverse direction T. The size and shape of the first shoulder 130 should be adapted to the inner valve 230 so as to form a reliable one-way valve as described previously.

The Second Shoulder

At the innermost end of the middle compartment 114, i.e. inwards of the first shoulder 130, the internal surface 102 of the housing 100 forms a second shoulder 140 providing an abutment for the inner valve 230. Hence the inner diameter of the housing 100 narrows to form a seat against which the inner valve 230 may abut in a direction substantially opposite to the dispensing direction in the longitudinal direction L. The size and shape of the second shoulder 140 should be adapted to the inner valve 230 so as to form a reliable one-way valve as described previously. In the illustrated embodiment, the second shoulder 140 cooperates with the inner valve 230 via the brace member 236, although it may, as an alternative, cooperate with the inner valve 230 directly.

The first shoulder 130 and the second shoulder 140 are hence adapted to cooperate with the inner valve 230 to restrict backward opening of the inner valve 230. As described, the two shoulders provide abutment in two different directions, however they both cooperate with the peripheral portion 234 of the inner valve 230. Hence the first shoulder 130 and the second shoulder 140 are located close to each other, e.g. within a range of 1-5 mm, or within a range of 2-4 mm. The interspace between the shoulders 130, 140 is defined between their respective outer edges. The size of the interspace between the shoulders 130, 140 is selected to be long enough to allow transport of the liquid and yet short enough to provide the desired support to the inner valve 230.

The Inner Compartment

Inside of the second shoulder 140, the housing 100 forms an inner compartment 116. The inner compartment 116 will house the brace member 236 and the fixation between the regulator 200 and the housing 100. In the illustrated embodiment, the fixation member 250 of the regulator 200 is fastened in a corresponding fixation groove 150 in the internal surface 102 of the inner compartment 116.

The Housing Wall

Generally, the thickness of the wall of the housing is relevant to ensure the required resilience of the chamber 100. It is understood that in the illustrated embodiment, the chamber 110 is substantially formed by the middle compartment 114 of the housing 100. Hence, the thickness of the wall of the housing 100 is relatively thin at the outer portion 114*a* of the middle compartment 114 for enabling compression of the chamber 110. The thickness of the wall of the housing at the outer compartment 112 and at the inner compartment 116 is relatively thick, such that the shape of the housing 100 is kept more constant at these compartments 112, 116. This ensures proper function of the inner and outer valves 230, 220. Likewise the thickness of the wall of the housing 100 in a region of the guide member 260, i.e. in the inner portion 114*b* of the middle compartment 114 is relatively thick, such that the guide member 260 can restrict the bending movement of the stem 210 and generally confine the bending to the portion of the stem 210 extending outside of the guide member 260.

The Collar

The innermost end of the housing 100 is provided with a connection member for connection, direct or via some additional connecting means, to the container 400. In the illustrated embodiment, the connection member comprises a collar 160 which is to be connected to the container 400 via a separate connector 300. The collar 160 extends from the innermost portion of the inner compartment 116 of the housing 100 in the longitudinal direction L of the housing 100. The collar 160 is, in this embodiment, generally conical extending outwardly from the innermost end.

The outer surface of the collar 160 may advantageously be provided with dents 162. In the described embodiment, the dents 162 form a stair-shape on the conical collar 160. The dents 162 help to provide a fluid-tight connection between the pump 1 and the container 400. The stair-shape gives a step-wise sealing, which is improved by the resiliency of the material of the collar 160.

The Connector

Figure 4A:
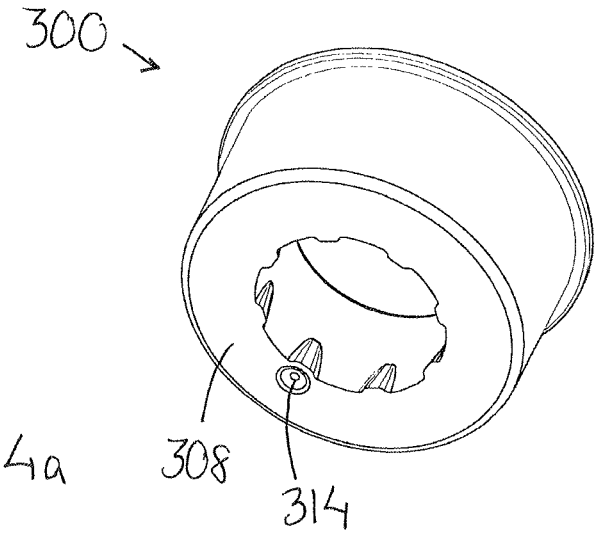
FIGS. 4*a* to 4*c* illustrate an embodiment of a connector for use with the pump of FIG. 1.
Figure 4B:
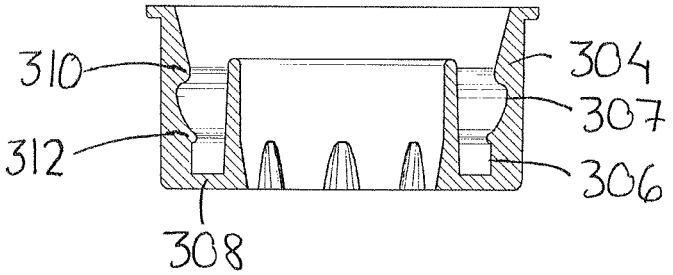
Figure 4C:
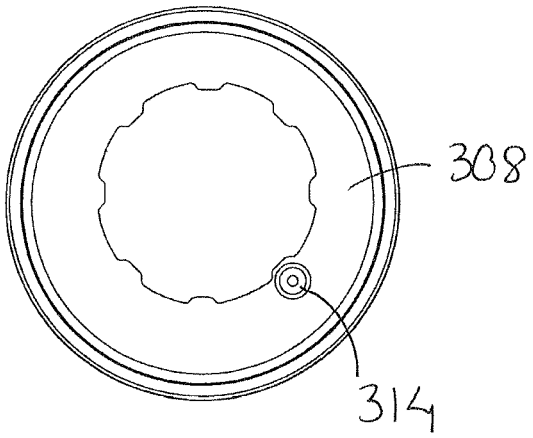

FIGS. 4*a* to 4*c* illustrate an embodiment of a connector 300 for connecting the pump of the illustrated embodiment to a container. FIG. 4*a* is a perspective view of the connector, FIG. 4*b* is a cross-sectional view of the connector, and FIG. 4*c* is a top view of the connector.

The connector 300 includes a generally ring-shaped base portion 308, forming an opening in which the pump will be arranged. An inner flange 302 extends from the inner periphery of the base portion 308, and an outer flange 304 extends from the outer periphery of the base portion 308. The outer flange 304 is provided with two circumferentially extending indentations 306, 307 on the side facing the inner flange 302. The flange 304 also includes a first protrusion 310 and a second protrusion 312, with one of the indentations 307 being located between the protrusions 310, 312.

The indentation 306 closest to the base portion 308 is intended to snap fit with the outermost portion of the collar 160 of the housing for connecting the pump to the connector 300. The other indentation 307 is intended to snap fit with a portion of the container 400 as will be described later when describing the assembly of the dispensing system.

FIGS. 4*a* and 4*c* further illustrates an ingate 314 used when manufacturing the connector 300.

Generally, it is believed to be advantageous having a connector 300 being provided with indentations 306, 307 for enabling snap-fit connection with the pump 1 and with the container 400. Moreover, it is believed that other embodiments of connectors providing other snap fit connections than the one described are conceivable. In particular, the shape, size and location of the snap-fit mechanisms may be varied, as may of course the design of the connecting structures of the housing and the container.

The Spray Nozzle Unit

The spray nozzle unit 500 includes an inner portion 510 and an outer portion 520.

The Inner Portion

Figure 5A:
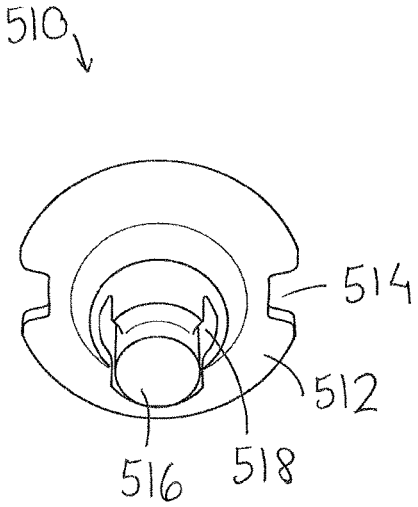
FIGS. 5*a* to 5*c* illustrate an embodiment of an inner portion of a spray nozzle unit according to an embodiment of a spray nozzle unit.
Figure 5B:
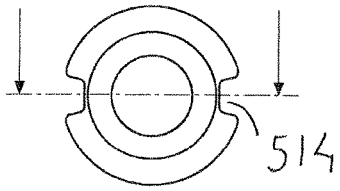
Figure 5C:
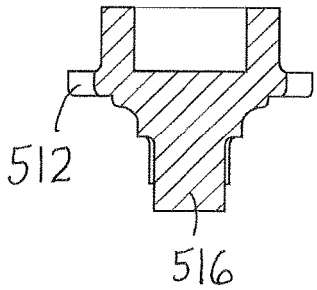

FIGS. 5*a* to 5*c* illustrate the inner portion 510 of the spray nozzle unit 500 for the illustrated embodiment. FIG. 5*a* is a perspective view, FIG. 5*b* is a view of the inner portion 510 as seen from above, and FIG. 5*c* is a cross-sectional view of the inner portion 510.

The inner portion 510 includes a flange 512. The inner portion 510 is adapted to be received by and attached to the outer portion 520, e.g. by means of a snap fit connection. The flange 512 may thereby be fitted into a corresponding groove 526 of the outer portion 520. The flange 512 includes at least one passage for the liquid, in the illustrated embodiment, two passages 514 at diametrically opposite sides of the flange 512.

The inner portion 510 further includes a base portion 516 directed outwards in the longitudinal direction. The base portion 516 includes at least one passage for the liquid, in the illustrated embodiment, two passages 518 at diametrically opposite sides of the base portion 516. The passages 518 of the base portion 516 are straight outwards of the passages 514 of the flange 512 as seen in the longitudinal direction, see the cross-section of FIG. 5*c*.

The dimensions of the uppermost part of the inner portion 510 is selected such that the knob 226 of the outer valve 220 will, if being displaced far enough longitudinally outwards, e.g. due to elongation in the longitudinal direction, be stopped by the inner portion 510.

The Outer Portion

Figure 6A:
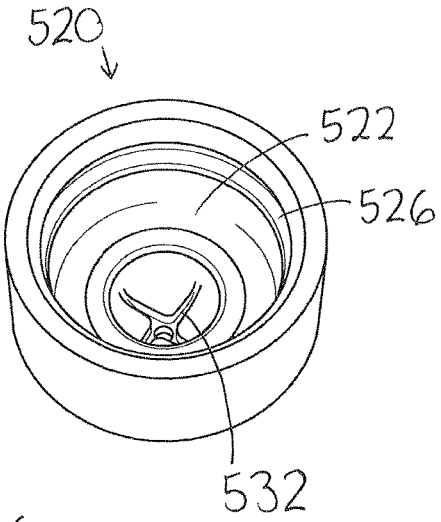
FIGS. 6*a* to 6*c* illustrate an embodiment of an outer portion of the embodiment of the spray nozzle unit.
Figure 6B:
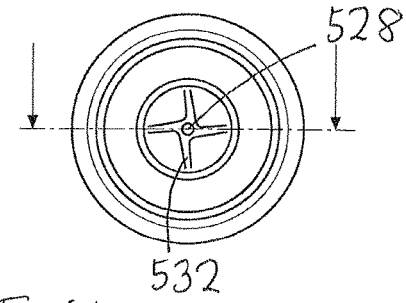
Figure 6C:
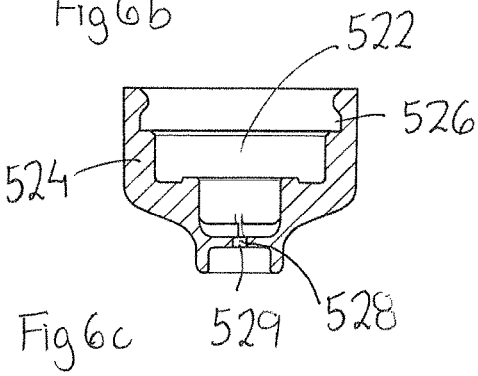

FIGS. 6*a* to 6*c* illustrate the outer portion 520 of the spray nozzle unit 500 for the illustrated embodiment. FIG. 6*a* is a perspective view, FIG. 6*b* is a view of the outer portion 520 as seen from above, and FIG. 6*c* is a cross-sectional view of the outer portion 520.

The outer portion 520 includes a cavity 522 for receiving the inner portion 510. The wall 524 of the cavity 522 includes the groove 526 for receiving the flange 512 of the inner portion 510. The outer portion 520 further includes a spray aperture 528 directed longitudinally outwards. The size and/or shape of the spray aperture 528, and in particular its outer end 529, may be selected dependent on the liquid to be dispensed. The size and/or shape of the outer end 529 can be selected such that the surface tension of the liquid prevents the liquid from dripping through the spray aperture 528. The outer end 529 of the spray aperture 528 may have a circular cross-sectional shape. Purely as an example, it has been found suitable to use a spray aperture wherein the outer end 529 has a diameter being in the range of 0.2 to 1 mm, or in the range of 0.4-0.6 mm, e.g. 0.5 mm, when dispensing soap as a spray.

In the illustrated embodiment, see FIGS. 6*a* and 6*c*, the spray aperture 528 forms a cylindrical tube. Due to the high pressure in the pump 1 a spray cone is obtained. It is hence possible to cover an area on the sprayed item, e.g. on a hand held below the pump, although the spray aperture 528 has a cylindrical shape. There is hence with a pump as described herein no need to make the spray aperture 528 conical in order to cover an area on the sprayed item. The size of the spray cone may be influenced by the external force applied to the pump. Generally, the higher the force is, the higher pressure is built up in the chamber, the wider the spray cone is formed.

The interspace between the inner portion 510 and the outer portion 520 forms a conduit 530 for the liquid as may be gleaned from FIG. 1 showing the same cross-section as FIGS. 5*c* and 6*c*. In illustrated embodiment, there are two conduits at diametrically opposite sides of the spray nozzle unit 500 for longitudinal transport of the liquid. The liquid may also stream along the periphery of the interspace below the flange 512. Further the liquid streams towards the axial centre line A, where the spray aperture 528 is located.

In order to obtain a spray, the liquid is broken up into droplets forming the spray. The process of forming the droplets of the spray is known as atomization. The process may be influenced by factors such as the level of the pressure in the pump, the size and/or shape of the spray aperture 528, the size and/or shape of the outer end 529 of the spray aperture 528, the size and/or shape of the conduits 530.

Just upstream of the spray aperture 528, there are arranged channels 532 in the outer portion 520. The positioning of the inner portion 510 in the outer portion 520 forces the liquid into the channels 532. The channels 532 are arranged such that they meet at an angle above the spray aperture 528. In the illustrated embodiment, there are four channels 532 meeting at right angles above the spray aperture 528. The channels 532 extend substantially perpendicular to the intended spray direction being in the longitudinal direction of the pump. The configuration with meeting channels has been found beneficial for forming the desired droplets of the liquid.

Assembly of Pump

Figure 7:
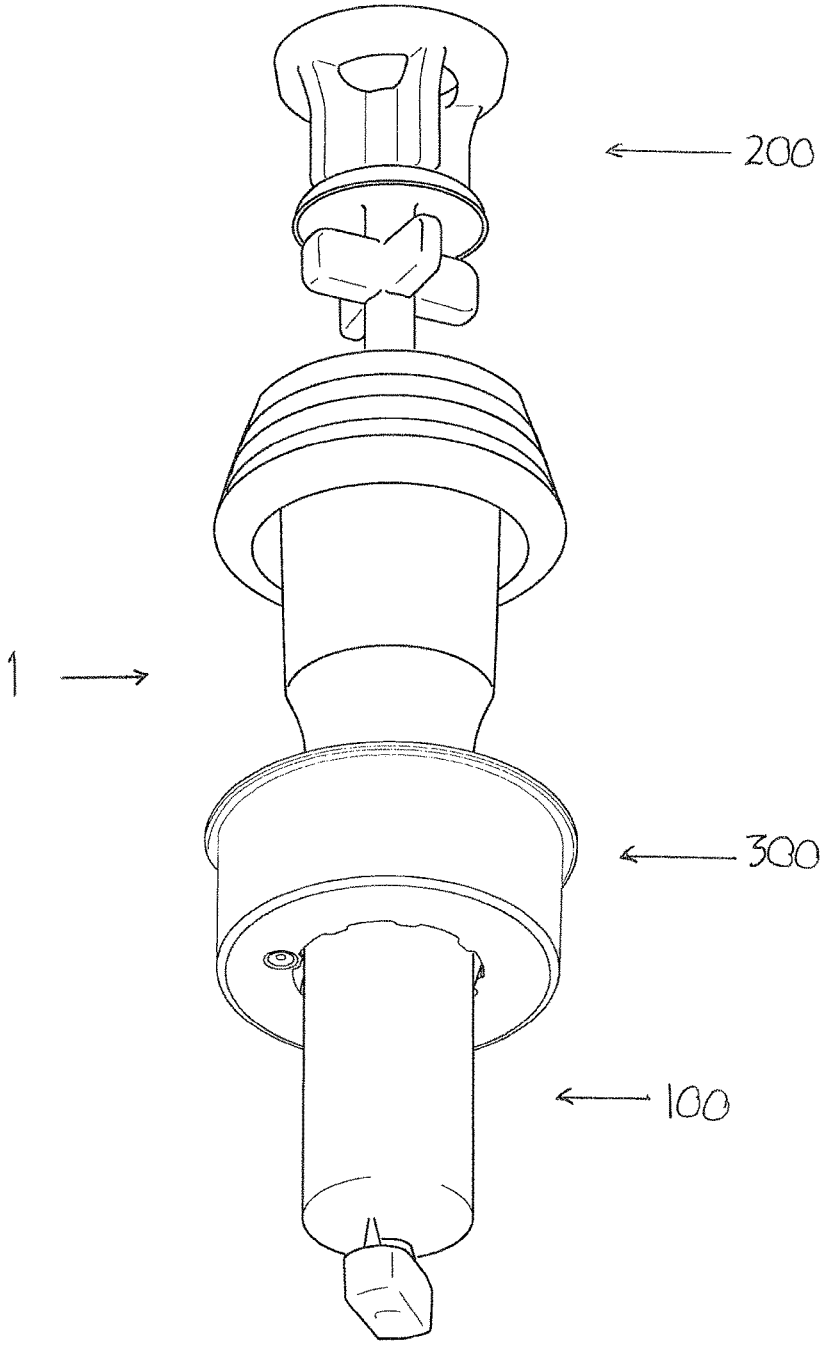
FIG. 7 illustrates an assembly of the regulator of FIGS. 2*a* to 2*c*, the housing of FIGS. 3*a* to 3*c*, and the connector of FIGS. 4*a* to 4*c*.

Advantageously, the pump 1 is formed as in the illustrated embodiment of four parts only. One part forms the regulator 200 and one part forms the housing 100. Two parts, the inner portion 510 and the outer portion 520 forms the spray nozzle unit 500. FIG. 7 illustrates how the connector 300, housing 100 and regulator 200 may be introduced into one another for forming a connector-pump assembly.

The spray nozzle unit 500 is assembled by fitting the inner portion 510 into the outer portion 520, e.g. by means of the above-mentioned snap-fit in the groove 526. Then the spray nozzle unit 500 inserted in the housing 100 and snap-fitted by means of the protrusion 180 of the internal surface 102 of the housing 100. Thereafter, the regulator 200 is introduced into the housing 100 such that the fixation member 250 of the regulator 200 may snap fit into a locking device in the housing 100, i.e. the fixation groove 150. Hence, assembly of the pump is particularly easy and reliable.

It is understood that the parts can be formed from resilient plastic material. Thus, the resilient properties of the materials are useful when forming the snap fits. However, for providing a reliable interlocking, it is understood that the snap fit must be relatively stable. The required stability may easily be provided by adapting the design and the thickness of the material and choice of material, e.g. the thickness of the fixation member 250 in the illustrated embodiment.

Moreover, when used with a connector 300 as described above, the assembled pump 1 is easily connected to the connector 300 by introducing the housing 100 through the ring opening of the connector 300, and providing a snap-fit interlock between the housing 100 and the connector 300. Hence, advantageously in the end directed towards the container 400, there is a first snap fit between the regulator 200 and the housing 100, and a second snap fit between the housing 100 and the connector 300.

In the illustrated embodiment, the second snap fit is achieved by an outmost dent of the dents 162 of the collar 160 of the housing 100 forming a snap-lock when received in the innermost indentation 306 in the outer flange 304 of the connector 300. The collar 160 is hence received between the inner flange 302 and the outer flange 304 of the connector 300.

Going back again to FIG. 1, a cross-sectional view of the connector-pump assembly is shown illustrating how the detailed features as described above come together in the illustrated embodiment.

The outer valve 220 resides in the outer compartment 112 of the housing 100, with its peripheral portion 224 and in particular the lip 228 in contact with the wall of the chamber 110. In FIG. 1, the stem 210 is relaxed in its original shape.

The middle compartment 114 of the housing 100 extends along a selected length and surrounds the stem 210. It is understood that the middle compartment 114 contributes to the volume to be pumped and provides space for the bending of the stem 210. Moreover, the middle compartment 114 is essentially the portion of the chamber 110 which will be compressed when pumping, which is why the size of the middle compartment 114 is also relevant for the suction force of the pump. As mentioned previously, the thickness of the walls of the middle compartment 114 may be selected so as to provide a resiliency being suitable for the pumping function.

However, at the inner portion **114*b* of the middle compartment 114 the thickness of the walls is increased, in order to stiffen the structure of the pump before reaching the inner valve 230. It may be noted that the thickness of the housing walls is relatively thick surrounding the inner valve 230 and the outer valve 220, but relatively thin to form a pumping section between them. The relatively thick-walled inner portion 114*b* of the middle compartment 114 surrounds the guide member 260 provided on the stem 210, which is likewise a structure for restricting the movements of the inner valve 230**.

The inner valve 230 is seen in place with its peripheral portion 234 contacting the first shoulder 130 of the housing 100. The brace member 236 acting to control the inner valve 230 is surrounded by the inner compartment 116 of the housing 100.

Finally, the fixation member 250 is in place in the fixation groove 150 of the housing 100, securing the regulator 200 in the housing 100.

It is understood that the illustrated embodiment of a pump 1 formed by a housing 100 and a regulator 200 may be used with other connectors than the embodiment described herein. To that end, the housing 100 may naturally be provided with other connection means 160 than those described herein.

However, the illustrated connector 300 is believed to be particularly advantageous due to its easy assembly and reliable fluid-tight connection. In this embodiment, the collar 160 is snap-fitted into the connector 300 as described previously. When the collar 160 is in place in the connector 300, it is seen that a space 320, 322 is formed between the collar 160 and the innermost protrusion 310 of the connector 300. It is understood, that a designated container 400 may be received in this space 320, 322 and snap-fit to lock using the innermost protrusion 310 of the connector 300, as is illustrated in FIG. 1. The dents 162 on the collar 160 will hence function to increase the friction and the stability of the snap-fit. The outermost protrusion 312 of the connector 300 is used to retain the collar 160 of the housing 100.

The System

Figure 8A:
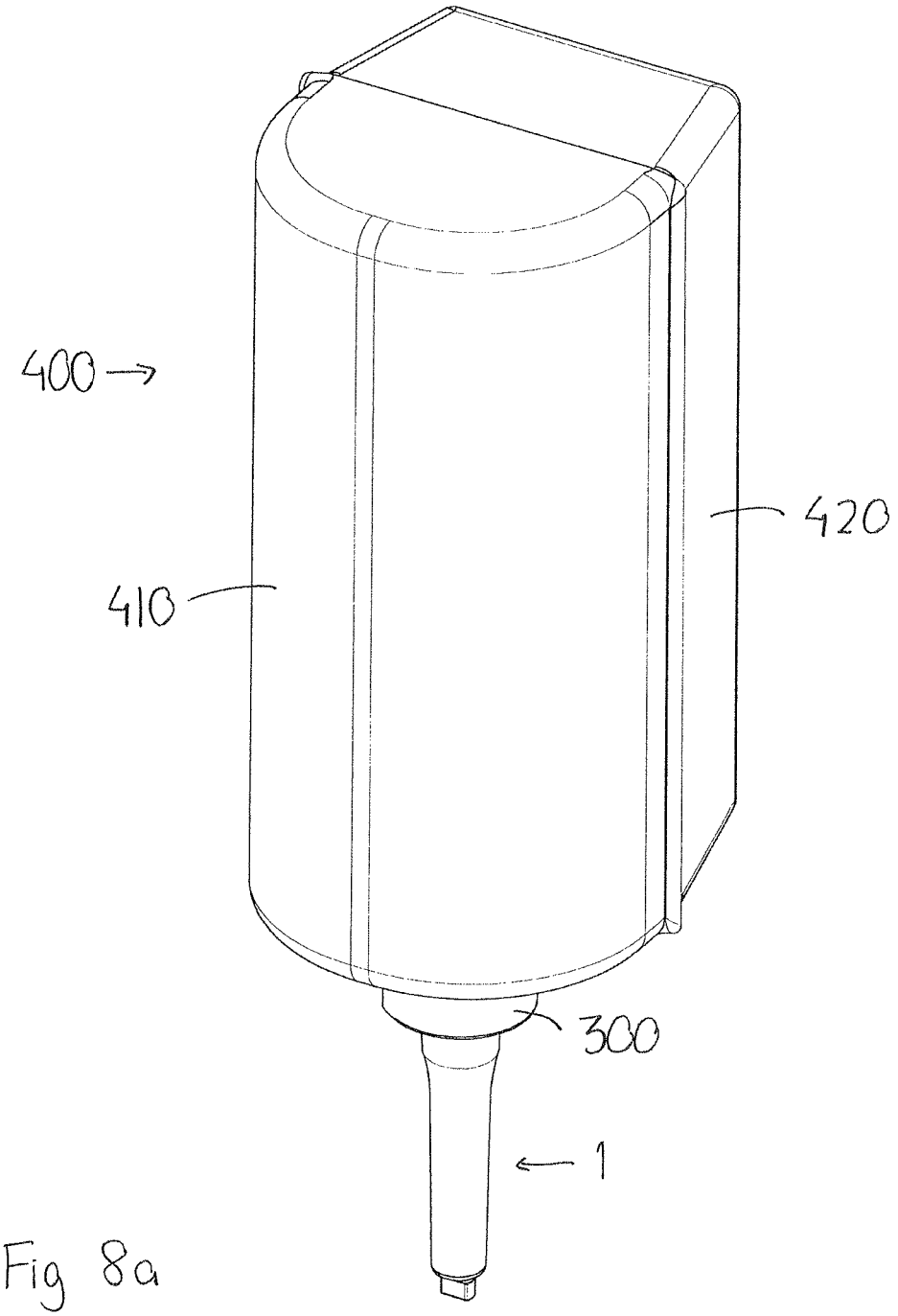
FIGS. 8*a* to 8*c* illustrate an embodiment of a system including a collapsible container, and the assembly of FIG. 7.
Figure 8B:
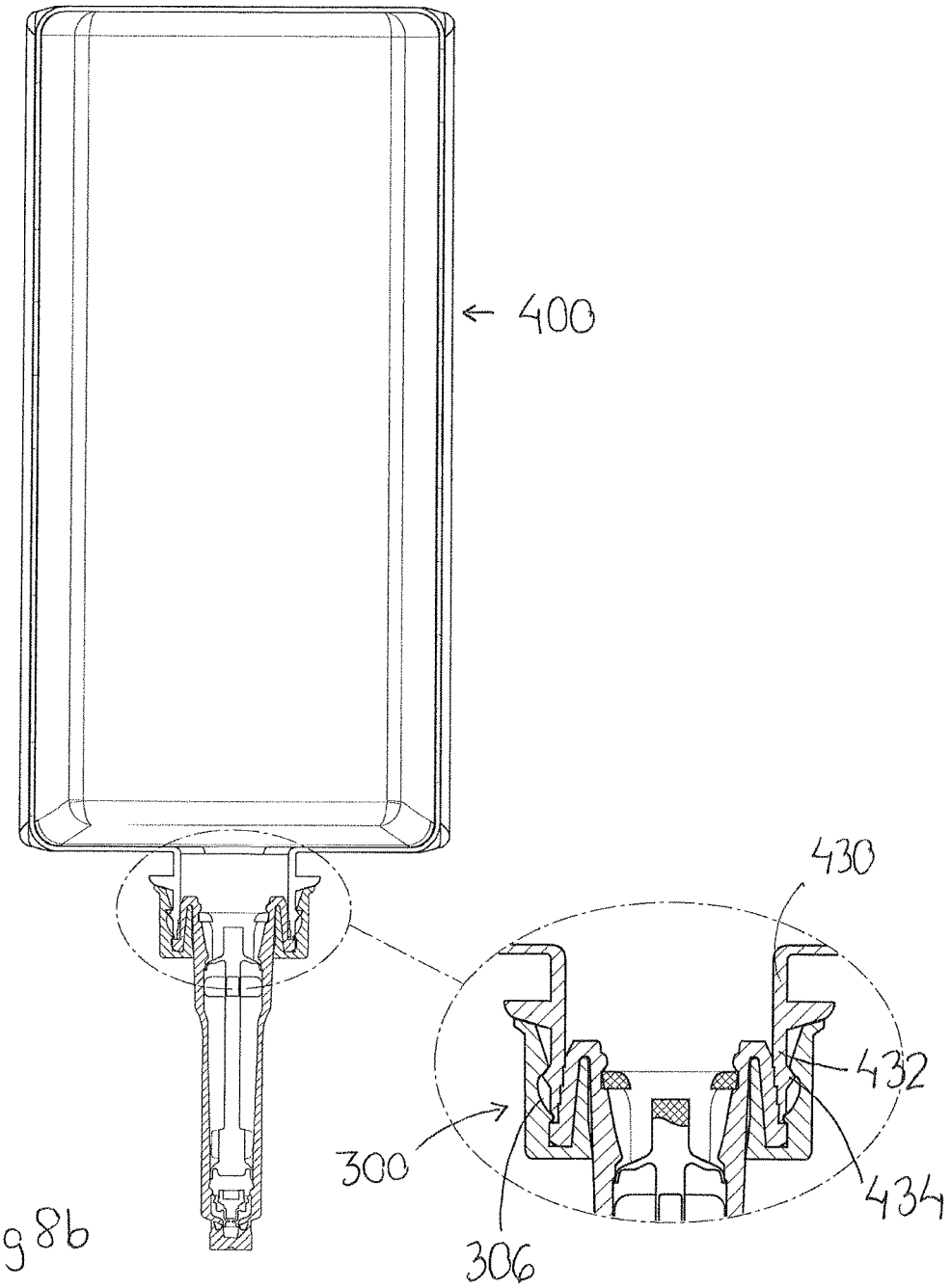

FIGS. **8*a* to 8*c* illustrate an embodiment of a dispensing system including a collapsible container 400, a pump 1 and a connector 300 as described above. FIG. 8*a* is a perspective view of the dispensing system, FIG. 8*b* is a cross-sectional view of the dispensing system, and FIG. 8*c*** is a bottom view of the dispensing system.

The pump 1 is located below the container 400, such that the spray direction substantially coincides with gravity.

The collapsible container 400 is advantageously a semi-rigid container, having a relatively rigid portion 410 and a collapsing portion 420. Generally, the difference in rigidity of the portions may be obtained by providing the portions with walls having different material thicknesses, the rigid portion 410 having a larger wall thickness than the collapsing portion 420.

The illustrated container 400 is believed to be particularly advantageous, having only one rigid portion 410 and one collapsing portion 420. The collapsing portion 420 may collapse into the rigid portion during emptying of the bottle. During collapse, the rigid portion 410 will provide sufficient support for maintaining a controlled position of the container 400 in e.g. a dispenser. This is particularly advantageous when information is to be printed on the container, and it is desired that said information shall be visible through e.g. a window in the dispenser throughout the emptying process.

The illustrated container 400 is divided longitudinally, such that the rigid portion 410 approximately forms one longitudinal half of the container 400, and the collapsing portion 420 approximately forms the other longitudinal half. An outlet 430 is formed as extending from an end wall of the rigid portion 410. See FIG. 8*b*. It is advantageous from a manufacturing point of view that the outlet 430 forms part of the rigid portion 410 and this further ascertains that the position and structure of the outlet 430 is stable.

Figure 8C:
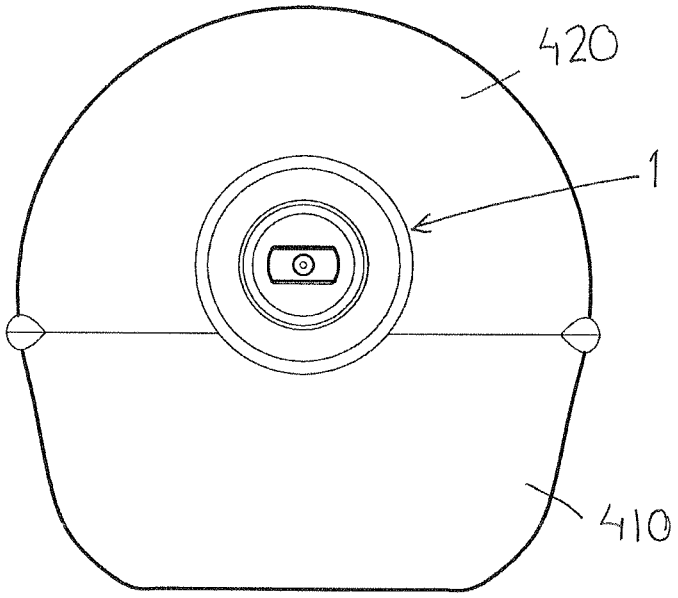

From FIG. 8*c* it may be gleaned how the pump 1 is arranged to the outlet 430 on the rigid portion 410 of the container. Moreover, it is seen that the rigid portion 410 in this case form a substantially regular cylindrical longitudinal outer wall, whereas the collapsible portion form a slightly expanded structure having a more irregular shape forming two bulbs or gentle corners.

In FIG. 8*b* the connection between the collapsible container 400 and the pump 1 via the connector 300 is illustrated, with particular reference to the enlargement. The connection between the pump 1 and the connector 300 has been described above. The container 400 is provided with a connection piece 432 at its outlet 430. The connection piece 432 is formed to be received in the open space 320, 322 formed between the collar 160 of the pump and the outer flange 304 of the connector 300, see FIG. 1. For accomplishing a snap-fit lock between the connector 300 and the container 400, the connection piece 432 is provided with a rib 434 to interlock with the innermost indentation 307 of the connector 300. The strength of the interconnection of the parts is increased by the dents 162 of the collar 160 which will contact the inside of the connection piece 432 of the container 400 and increase the friction against disassembly of the parts. The dents 162 help to provide a fluid-tight connection between the pump 1 and the container 400.

It is understood, that due to the snap fit connection of all of the components, the assembly of the entire system is particularly easy. Nevertheless, the connection is fluid-tight and reliable, ensuring that no air or contaminants are introduced into the system, and that the system does not leak.

Manufacture and Materials

The regulator and the housing may advantageously be manufactured of polypropene-based materials. The materials should be selected so as to provide sufficient resiliency for the desired functions. For the functions being dependent on the ability of the material to resume its original shape after distortion, it is believed that the parts should be able to resume its shape after at least 3000 distortions, in order for the function to be guaranteed until a container is emptied. This number is of course dependent on the size of the container, and is to be seen as an approximation only. Pumps have been manufactured where the parts withstand at least 10 000 distortions, which is well over the estimated requirements.

The regulator and the housing may advantageously be formed from low density materials.

Moreover, the materials in the pump should be selected such that they may withstand the liquid to be pumped, that is without being dissolved thereby.

In particular embodiments, the material or materials in the pump shall be of the same type such that the pump is recyclable as a single unit, without previous disassembly.

Advantageously, the regulator and the housing may be injection-moulded.

The container may advantageously be formed from a polypropylene-based material or a HDPE material. It is particularly advantageous if the container is formed from a material of the same type as the materials in the pump, such that the entire dispensing system may be disposed and recycled as one single unit, for example without previous disassembly.

The container may advantageously be blow-moulded.

A Dispensing-Refill Cycle

Figure 9A:
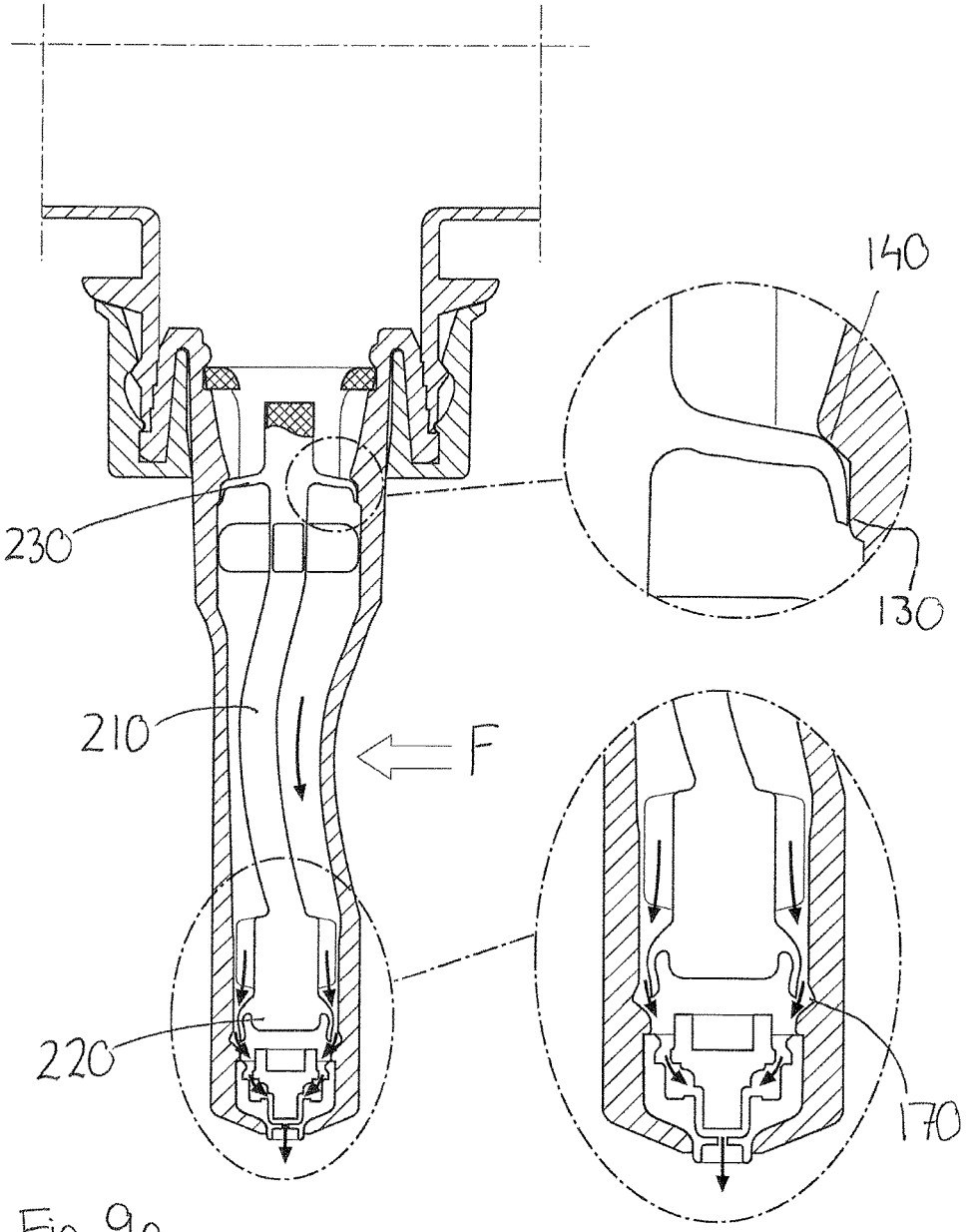
FIGS. 9*a* and 9*b* illustrate schematically a dispensing/refill cycle of the embodiment of FIG. 1.
Figure 9B:
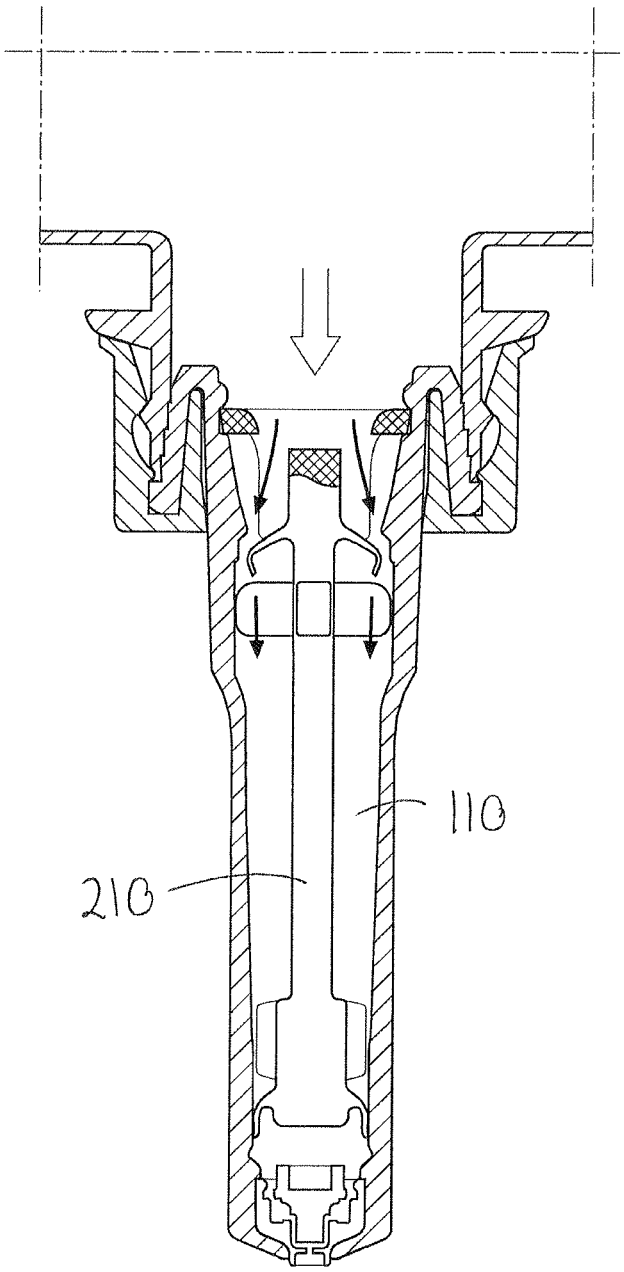

FIG. 1 together with FIGS. 9*a* and 9*b* schematically illustrate one dispensing-refill cycle of the embodiment of the pump 1. For simplicity, FIGS. 9*a* and 9*b* have been stripped from some of the features being dispensable when explaining the general functions of the pump. Instead, detailed features of the illustrated embodiment are explained in relation to the other figures.

The Closed Position

FIG. 1 illustrates the pump when in a closed position. In this application, the term "closed position" is used for a position in which no flow occurs between the chamber 110 and the dispensing opening 120. In FIG. 1, the pump 1 is in a closed position, which is also a storage position in which no flows take place in the system. The stem 210 is in its original relaxed shape. There is hence no external force applied. That is, the regulator 200 controls the flows such that no flow of liquid occurs between the container 400 and the chamber 110 or the chamber 110 and the dispensing opening 120. In the illustrated embodiment, the outer valve 220 and the inner valve 230 are both closed and in sealing contact with walls of the chamber 110. When in use, the chamber 110 will be full with liquid when the pump is in the storage position.

The Dispensing Position

FIG. 9*a* illustrates the pump when in a dispensing position. In this application, the term "dispensing position" is used for a position in which a volume of liquid may be drawn from the chamber 110 to the dispensing opening 120. The stem 210 has been displaced to a distorted shape by an external force F being transferred to the regulator 200. The exact shape of the stem 210 depends on factors like material properties of the stem 210 and the housing 100, the magnitude of the force F, the direction of the force F and where the force F is applied. The stem 210 bends sideways, i.e. in the transverse direction T. The force F can be applied in the transverse direction T being perpendicular to the longitudinal direction L. However, the force may also be substantially transverse or at least have a transverse component being larger than its longitudinal component. Also, the housing 100 is in a distorted shape caused by the external force F. The compression of the chamber 110 will cause the pressure therein to increase, which makes the outer valve 220 open, i.e. be set it in a dispensing position, such that liquid will be pressed out from the chamber 110 towards the dispensing opening 120. The compression of the chamber 110 and the bending of the regulator 200 hence set the pump in the dispensing position.

When the stem 210 is bent to its distorted shape and/or the stem 210 is extended due to the high pressure, the outer valve 220 is longitudinally displaced in relation to the guide region 104 of the housing 100, such that the peripheral portion 224 and in particular the lip 228 of the outer valve 220 moves closer to the groove 170 forming the first passage. Thereby the liquid may easily pass the outer valve 220. The outer valve 220 is then in the dispensing position illustrated by FIG. 9*a*. The external force F executes both the compression of the chamber 110, resulting in increased pressure in the chamber 110, and the bending of the regulator 200, resulting in the desired relative displacement of the outer valve 220. The outer valve 220 is longitudinally displaced. It is not tilted. Further, the increased pressure may cause the stem 210 to extend, which also contributes to the relative displacement of the outer valve 220.

The inner valve 230 is closed, for example abutting against both the first shoulder 130 and the second shoulder 140.

In the above, the general principle of a pump having an outer valve being displaceable from a closed position to a dispensing position has been described with reference to FIGS. 1 and 9*a*. It is to be understood that other embodiments may be envisaged that would use this general principle. For example, although less advantageous, one could imagine using a regulator 200, only a portion of which would be made resilient, or a regulator 200 including a number of parts of which only one is resilient to accomplish the displacement of the outer valve.

Automatic Return Mechanism

The description of the illustrated embodiment will now continue with particular reference to FIG. 9*b*.

In the illustrated embodiment, the chamber 110 and the regulator 200 are both formed from resilient materials, for example plastic materials. In the dispensing position as illustrated in FIG. 9*a*, both the chamber 110 and the regulator 200 are distorted from their original shapes, which are seen in FIG. 1. When the force F is removed, the chamber 110 and the regulator 200 will both automatically return to their original shapes, and hence return to a closed position as illustrated in FIG. 9*b*.

After dispense of liquid, when the external force is removed, the chamber 110 reassumes its original shape and hence expands. The regulator 200 reassumes its original shape resulting in the outer valve 220 reassuming its closed position, closing the chamber 110. The expansion of the chamber 110 creates a negative pressure in the chamber 110, which will cause the inner valve 230 to open, as illustrated in 9*b*. Liquid will hence be drawn from the container 400 to the chamber 110 to fill the chamber 110. Once the chamber 110 is refilled, there is no negative pressure in the chamber 110, and the inner valve 230 will close again, returning the pump to the original position of FIG. 1.

In the above, and in the following description, it is to be understood that the pump being in a closed position refers to the pump being closed such that no liquid may pass through the dispensing opening 120. The outer valve 220 then is in its closed position.

In the illustrated embodiment, the automatic return of the pump 1 from the dispensing position to the closed position is accomplished by the regulator 200 and the chamber 110 both reassuming their original shapes after distortion thereof. Hence, in this embodiment, both the regulator 200 and the chamber 110 form return means formed by the material of the pump parts. Hence, in the above, the general principle of a pump having return means formed by resilient plastic material of the pump and using said resiliency to cause automatic return of the pump has been described with reference to FIGS. 1, 9*a* and 9*b*. Moreover, the return means are sufficient to overcome the negative pressure created in a collapsible container. It is to be understood that other embodiments may be envisaged that would use this general principle. For example, although it is believed to be less advantageous, one could imagine that only one of the regulator or the chamber form the return means.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. A pump for a system for dispensing a liquid as a spray, comprising:

a dispensing opening;

a resilient housing having a longitudinal direction and forming a chamber capable of having a pressure within the chamber varied for pumping liquid from said container to said chamber and further from said chamber to said dispensing opening;

a regulator fixedly arranged in said chamber and comprising:

an inner valve for regulating a flow of liquid between said container and said chamber;

an outer valve for regulating a flow of liquid between said chamber and said dispensing opening;

a stem extending in said longitudinal direction of said housing at least between said inner valve and said outer valve, said stem being resilient along its length so as to be sideways bendable from an original shape to a distorted shape; and a displacement guide located at an outer portion of said stem on an inner side of said outer valve, wherein said housing further comprises a guide region located adjacent to said displacement guide, and wherein an outer perimeter of said displacement guide and at least a portion of an internal surface of said guide region are adapted to each other so as to allow relative displacement via sliding contact between said displacement guide and said guide region along said longitudinal direction of said housing, so as to transfer said sideways bending of said stem to a relative displacement between said outer valve and said housing along said longitudinal direction of said housing.

2. The pump according to claim 1, wherein said relative displacement results in a displacement of said outer valve towards said dispensing opening when said stem moves from said original shape to said distorted shape.

3. The pump according to claim 1, wherein said outer perimeter of said displacement guide is located at a larger radial distance from an axial centre line of said stem than a radial distance of a main surface of said stem.

4. The pump according to claim 1, wherein said displacement guide forms a portion of said regulator.

5. The pump according to claim 1, wherein a cross-sectional area of said chamber is less in said guide region than in a region of said chamber being longitudinally inwards of said guide region.

6. The pump according to claim 1, wherein an internal surface of said housing comprises at least one first passage for said liquid, said first passage being located longitudinally outwards of said outer valve when said stem is in said original shape.

7. The pump according to claim 6, wherein said first passage forms a groove in said internal surface of said housing, said groove extending substantially perpendicular to said longitudinal direction of said housing.

8. The pump according to claim 6, wherein said relative displacement results in a displacement of said outer valve towards said dispensing opening to a location adjacent to said first passage when said stem is in said distorted shape.

9. The pump according to claim 1, wherein said displacement guide, said guide region, or both comprise at least one second passage for said liquid longitudinally passing said displacement guide.

10. The pump according to claim 1, wherein said inner valve comprises a central portion and a peripheral portion, said central portion being more rigid than said peripheral portion.

11. The pump according to claim 1, wherein an internal surface of said housing comprises a first shoulder adapted to cooperate with a peripheral portion of said inner valve to form an inner seal.

12. The pump according to claim 11, wherein said internal surface of said housing comprises a second shoulder adapted to form an abutment for said inner valve, said second shoulder being located longitudinally inwards of said first shoulder, said chamber having a smaller cross-sectional area at said second shoulder than at said first shoulder.

13. The pump according to claim 1, wherein said outer valve comprises a central portion and a peripheral portion, said central portion being more rigid than said peripheral portion.

14. The pump according to claim 13, wherein said peripheral portion of said outer valve comprises a lip adapted to cooperate with said internal surface of said housing, said lip protruding in a direction towards an internal surface of said housing.

15. The pump according to claim 1, wherein said pump comprises a one-piece housing and a one-piece regulator, said guide region and said displacement guide forming a portion of said housing and said regulator, respectively.

16. The pump according to claim 1, further comprising a spray nozzle unit at the dispensing opening.

17. The pump according to claim 16, wherein said spray nozzle unit comprises:

an outer portion comprising a cavity and a spray aperture for dispensing said spray in a spray direction;

an inner portion fitting into said cavity of said outer portion in such a way that at least one conduit for said liquid is provided through said spray nozzle unit; and at least two channels for transport of said liquid, which channels are arranged to meet adjacent to said spray aperture, said channels being in fluid connection with said at least one conduit and extending substantially perpendicular to said spray direction.

18. The pump according to claim 17, wherein said channels of said spray nozzle unit are formed as grooves in said outer portion.

19. The pump according to claim 17, wherein said spray nozzle unit comprises four of said channels.

20. The pump according to claim 17, wherein said outer portion of said spray nozzle unit comprises a groove in a wall of said cavity, said inner portion being adapted to be snap-fitted into said groove.

21. The pump according to claim 17, wherein said spray aperture of said spray nozzle unit comprises parallel walls.

22. The pump according to claim 1, wherein said pump consists of plastic material.

23. A dispensing system for dispensing a liquid as a spray comprising:

the pump according to claim 16; and a collapsible container for containing liquid to be dispensed via said pump, said pump being in fluid-tight connection with said collapsible container.

24. The dispensing system according to claim 23, wherein said pump is adapted to be located vertically below said collapsible container.

25. A method for dispensing a liquid as a spray from the dispensing system according to claim 23 comprising:

subjecting said chamber to an external force, said external force providing an increased pressure in said chamber;

letting said external force bend said stem sideways to said distorted shape; and transferring said sideways bending of said stem to a relative displacement between said outer valve and said housing along said longitudinal direction of said housing by said displacement guide, thereby allowing said liquid to pass said outer valve.

26. The method according to claim 25, wherein said relative displacement between said outer valve and said housing along said longitudinal direction of said housing comprises an extension of said stem due to said increased pressure in said chamber provided by said external force.

* * * * *